US005862985A

United States Patent [19]

Neibrook et al.

[11] Patent Number: 5,862,985

[45] Date of Patent: Jan. 26, 1999

[54] SHOWERHEAD

[75] Inventors: Dennis W. Neibrook, Harrisonville; Bryce D. Schellhorn, Clinton, both of Mo.

[73] Assignee: The Rival Company, Kansas City, Mo.

[21] Appl. No.: 694,696

[22] Filed: Aug. 9, 1996

[51] Int. Cl.[6] ..... B05B 1/16

[52] U.S. Cl. ..... 239/99; 239/447; 239/449; 239/428.5

[58] Field of Search ..... 239/447–449, 239/428.5, 600, 443, 381, 383, 242, 99

[56] References Cited

U.S. PATENT DOCUMENTS

| | | |
|---|---|---|
| Re. 30,350 | 7/1980 | Peterson et al. . |
| D. 251,678 | 4/1979 | Kwan . |
| D. 267,581 | 1/1983 | Mackay et al. . |
| D. 290,497 | 6/1987 | Huen . |
| D. 295,437 | 4/1988 | Fabian . |
| D. 313,833 | 1/1991 | Presman . |
| D. 323,545 | 1/1992 | Ward . |
| D. 334,048 | 3/1993 | Ben-Zur . |
| D. 369,205 | 4/1996 | Andrus . |
| D. 370,052 | 5/1996 | Chan et al. . |
| 1,890,156 | 12/1932 | Konig . |
| 2,671,693 | 3/1954 | Hyser et al. . |
| 2,935,265 | 5/1960 | Richter . |
| 3,344,994 | 10/1967 | Fife . |
| 3,485,451 | 12/1969 | Gore et al. . |
| 3,563,469 | 2/1971 | Stacey . |
| 3,568,716 | 3/1971 | Heitzman . |
| 3,713,587 | 1/1973 | Carson . |
| 3,762,648 | 10/1973 | Deines et al. . |
| 3,801,019 | 4/1974 | Trenary et al. . |
| 3,868,949 | 3/1975 | Arneson . |
| 3,924,808 | 12/1975 | Cooley, Jr. . |
| 3,929,827 | 12/1975 | Givler et al. . |
| 3,958,756 | 5/1976 | Trenary et al. . |
| 3,963,179 | 6/1976 | Tomaro . |
| 4,043,511 | 8/1977 | Nakamura . |
| 4,055,301 | 10/1977 | Hruby, Jr. . |
| 4,068,801 | 1/1978 | Leutheuser . |
| 4,079,891 | 3/1978 | Kwan . |
| 4,081,135 | 3/1978 | Tomaro . |
| 4,089,471 | 5/1978 | Koenig . |
| 4,101,075 | 7/1978 | Heitzman . |
| 4,131,233 | 12/1978 | Koenig . |
| 4,141,502 | 2/1979 | Grohe . |
| 4,165,837 | 8/1979 | Rundzaitis . |
| 4,187,986 | 2/1980 | Petrovic . |
| 4,190,207 | 2/1980 | Fienhold et al. . |
| 4,203,550 | 5/1980 | On . |
| 4,204,646 | 5/1980 | Shames et al. . |
| 4,221,338 | 9/1980 | Shames et al. . |
| 4,254,914 | 3/1981 | Shames et al. . |
| 4,274,595 | 6/1981 | Yamin . |

(List continued on next page.)

FOREIGN PATENT DOCUMENTS 2 081 607 2/1982 United Kingdom .

OTHER PUBLICATIONS

Craftech Collection, "Hand Shower" (1995).

*Primary Examiner*—Kevin Weldon
*Attorney, Agent, or Firm*—Brinks Hofer Gilson & Lione

[57] ABSTRACT

A showerhead comprises a shell having an outlet end and a selector housing having an inlet end fixedly mounted to the outlet end of the shell. The showerhead also has a selector disk removably and rotatably mounted inside the selector housing near the inlet end of the selector housing. The disk selector has an inlet end facing the inlet end of the selector housing, and an outlet end opposite the inlet end of the disk selector. The showerhead further includes a selector face mounted inside the selector housing. The selector face has an inlet end abutting the outlet end of the selector disk, and an outlet end opposite the inlet end of the selector face. The showerhead also has a diffuser plate mounted inside the selector housing. The diffuser plate has an inlet end abutting the outlet end of the selector face, and an outlet end opposite the inlet end of the diffuser plate.

23 Claims, 15 Drawing Sheets

U.S. PATENT DOCUMENTS 4,303,201 12/1981 Elkins et al. .
4,324,364 4/1982 Buzzi et al.. .
4,330,089 5/1982 Finkbeiner .
4,346,844 8/1982 Harmony .
4,398,669 8/1983 Fienhold .
4,478,367 10/1984 Petursson .
4,579,284 4/1986 Arnold .
4,582,253 4/1986 Gerdes .
4,588,130 5/1986 Trenary et al. .
4,618,100 10/1986 White et al. .
4,629,125 12/1986 Liu .
4,640,462 2/1987 Stearns, III .
4,674,687 6/1987 Smith et al. .
4,709,691 12/1987 Lemons et al. .
4,732,193 3/1988 Gibbs .
4,733,818 3/1988 Aghnides .
4,733,819 3/1988 Agnides, deceased .
4,753,260 6/1988 Gibbs .
4,754,928 7/1988 Rogers et al. .
4,801,091 1/1989 Sandvik .
4,838,486 6/1989 Finkbeiner .
5,033,897 7/1991 Chen .
5,070,864 12/1991 Lemons .
5,090,624 2/1992 Rogers .
5,111,994 5/1992 Gonzalez .
5,127,580 7/1992 Fu-I .
5,154,355 10/1992 Gonzalez .
5,169,072 12/1992 Gulyas .
5,172,866 12/1992 Ward .
5,201,468 4/1993 Freier et al. .
5,215,258 6/1993 Jursich .
5,246,169 9/1993 Heimann et al. .
5,248,092 9/1993 Rankin .
5,294,054 3/1994 Benedict et al. .
5,316,216 5/1994 Cammack et al. .
5,356,077 10/1994 Shames et al. .
5,381,957 1/1995 Bianco .
5,397,064 3/1995 Heitzman .
5,398,872 3/1995 Joubran .
5,433,384 7/1995 Chan et al. .
5,467,927 11/1995 Lee .
5,476,225 12/1995 Chan .
5,495,627 3/1996 Leaverton et al. .
5,518,181 5/1996 Shames et al. .
5,540,385 7/1996 Roman .
5,551,637 9/1996 Lo ..... 239/449 X Fig. 1
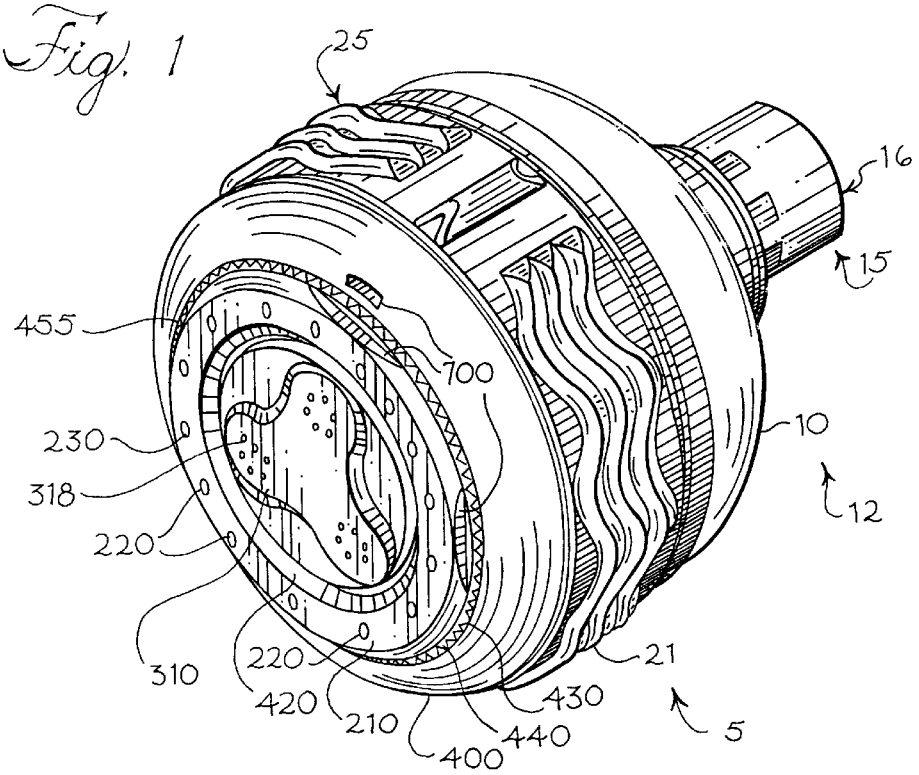
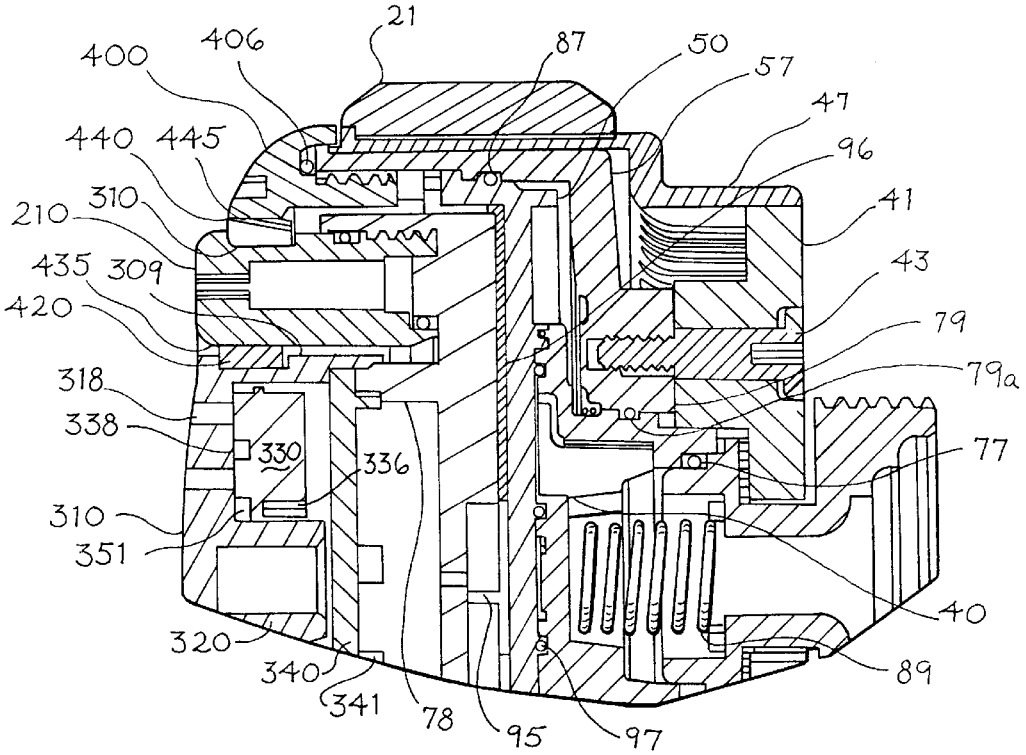
Fig. 2

TO FIG. 3C

SHOWERHEAD

BACKGROUND OF THE INVENTION

This invention relates to an improved showerhead. More specifically, the invention relates to a multi-mode showerhead having different combinations of continuous and pulsating sprays.

Numerous showerheads have been developed over the years for enabling the delivery of continuous and pulsating sprays of water. In recent times, comparatively great commercial attention has been directed at showerheads that provide both continuous and pulsating sprays, and various combinations thereof. One example of such a showerhead is described in Harmony, U.S. Pat. No. 4,346,844. Harmony shows an aerated pulsating showerhead having an inner shell rotatable within an outer shell to provide two different aerated water paths upon rotation of the inner shell within the outer shell. The first water path is discharged in the form of an aerated continuous spray while the second water path is discharged in the form of an aerated pulsating spray. Harmony also shows a non-pulsating aerated spray showerhead. However, the Harmony showerhead does not have a non-aerated spray, either in a pulsating or non-pulsating spray mode. As a result, the Harmony showerhead is limited in the various spray modes that it can provide to a user. Moreover, the Harmony showerhead only has two water paths that are activated upon rotation of the entire inner shell within the outer shell. This inner and outer shell design provides a showerhead that is cumbersome in structure and appearance to a user.

Another example of a showerhead that provides both continuous and pulsating sprays, and various combinations thereof, is described in Rogers et al., U.S. Pat. No. 4,754,928. Rogers et al. shows a variable massage showerhead having an inlet end and an outlet end which rotates relative to the inlet end upon operation of a side knob. Depending upon the position of the outlet end, the Rogers et al. showerhead is capable of achieving four sprays: (1) a continuous spray, (2) a pulsating spray, (3) a combination continuous and pulsating spray, and (4) a pulsating misting spray. The Rogers et al. showerhead, however, does not have an aerated spray of any kind. Such aerated conveyances are desirable because they provide the user with the sensation of having more water flow than is actually being used. In addition, the entire outlet end of the Rogers et al. showerhead rotates with respect to the inlet end in order to change the spray mode. Therefore, the Rogers et al. showerhead poses the same structural problems as the Harmony showerhead.

Accordingly, it is an object of the present invention to provide a showerhead that is an improvement over the above prior art showerheads. The showerhead of the present invention provides a user with regular continuous spray, an aerated spray, a pulsating spray, and several combinations thereof. Therefore, the showerhead of the present invention has a wide range of different spray modes and combinations of spray modes for a user.

It is also an object of the present invention to achieve a new and better component arrangement for selecting among different spray modes and combinations thereof.

Yet another object of the present invention is to provide a new and improved showerhead in which the critical components of the showerhead with respect to the various spray modes may be easily removed from the showerhead for cleaning and restoration of free-flow through the critical components.

Another object of the present invention is to provide a new and improved aeration spray system to provide a generous aerated shower while using relatively simple components.

Yet another object of the present invention is to provide a new and improved system for providing a pulsating or massaging spray of water, again using relatively few and simple components.

A related object of the present invention is to provide such a showerhead wherein the removal of a component for cleaning and its ultimate reattachment to the showerhead may be accomplished easily and without any opportunity for damage to other operative components of the showerhead.

SUMMARY OF THE INVENTION

The present invention provides a showerhead including a shell having an inlet end and an outlet end spaced from the inlet end, and a selector housing having an inlet end and an outlet end. The inlet end of the selector housing is fixedly mounted to the outlet end of the shell.

In another aspect of the present invention, the showerhead of the present invention also includes a selector disk removably and rotatably mounted inside the selector housing near the inlet end of the selector housing. The selector disk has an inlet end facing the inlet end of the selector housing, and an outlet end opposite the inlet end of the selector disk.

In yet another aspect of the present invention, the showerhead includes a selector face threadably mounted inside the selector housing. The selector face has an inlet end flush against the outlet end of the selector disk, and an outlet end opposite the inlet end of the selector face.

A diffuser plate is also mounted inside the selector housing of the showerhead. The diffuser plate has an inlet end flush against the outlet end of the selector face, and an outlet end opposite the inlet end of the diffuser plate.

The selector disk has at least one axially throughgoing hole that matches up with an axially throughgoing hole on the selector face. The diffuser plate, which lies flush against the selector face, includes a channel in fluid communication with the hole in the selector face. When properly aligned, water flows from the selector disk, through its axially throughgoing hole, through the selector face, through the diffuser plate, and into the channel on the diffuser plate. The channel is further linked to the outlet end of the showerhead or to various water outlets.

Thus, the present invention provides an improved showerhead which offers a variety of water outlets readily selectable by the user. In particular, a massaging spray, an aerated spray, a normal wide spray, a normal narrow spray, and various combinations thereof may be selected. Furthermore, the system offers relatively few components and simple interlocking parts to allow for simplified disassembly and cleaning when necessary.

It is to be understood that both the foregoing general description and the following detailed description are exemplary and explanatory and are intended to provide further explanation of the invention as claimed.

The invention, together with further objects and attendant advantages, will best be understood by reference to the following detailed description, taken in conjunction with the accompanying drawings.

BRIEF DESCRIPTION OF THE DRAWINGS

FIG. 1 is a perspective view of a first preferred embodiment of a showerhead of the present invention.

FIG. 2 is an assembly drawing of the showerhead of FIG. 1.

DETAILED DESCRIPTION OF THE PREFERRED EMBODIMENTS

Figure 3A:
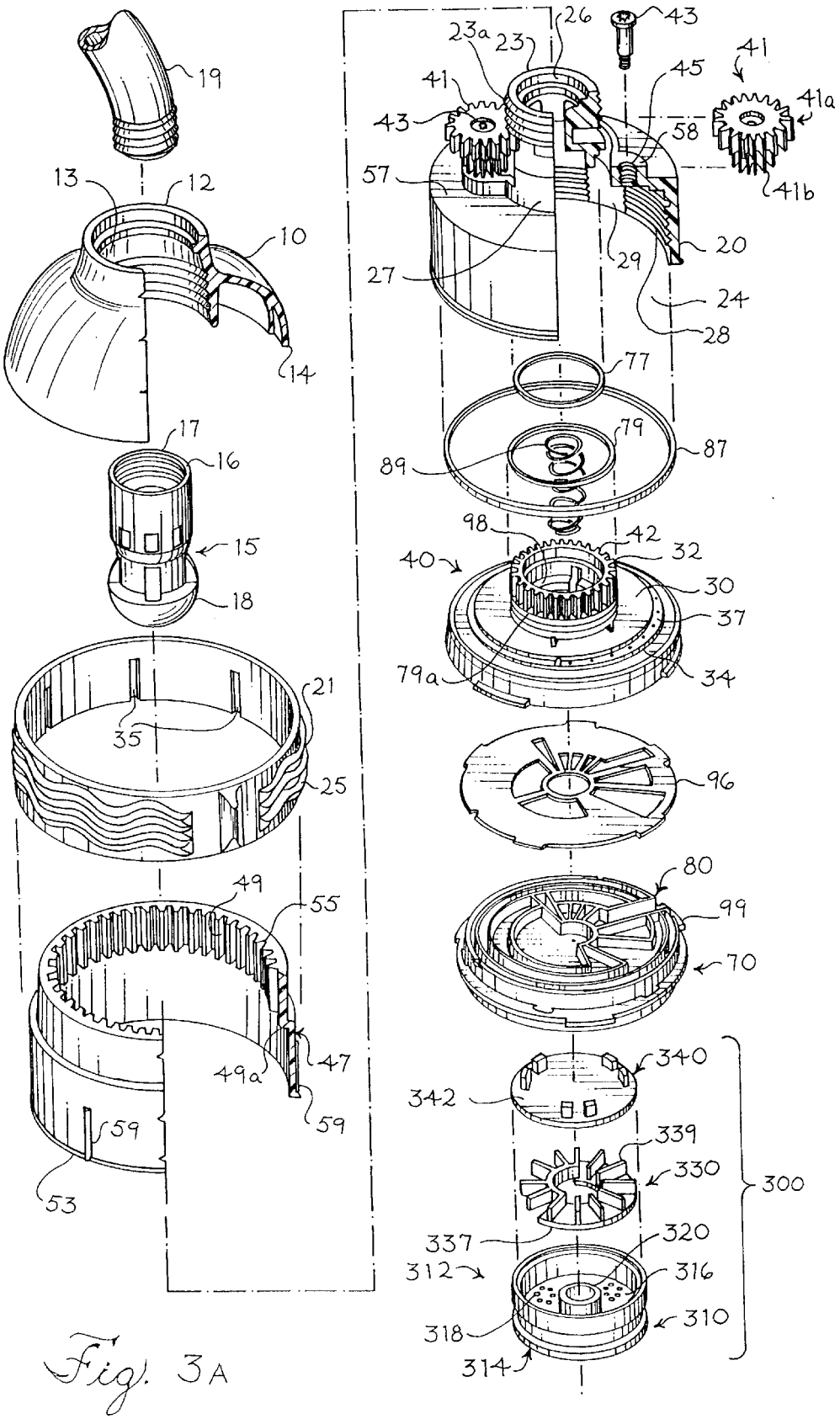
FIG. 3A is an exploded perspective assembly drawing of the showerhead of FIGS. 1 and 2.

Turning now to the drawings, FIG. 1 is a perspective view of the showerhead of a first preferred embodiment, in particular showing the various outlet orifices, including the massaging outlet holes 318, inner steady spray ring 420, aeration ring 210 including aerated spray outlets 220, and outer steady spray ring 455. These orifices preferably are used to convey water from a water supply in various user-selectable modes. FIGS. 2 and 3 show a cross-sectional assembly drawing and an exploded view, respectively, of the first preferred embodiment including a shell 10, a selector housing 20, a selector disk 30, a selector face 50, a diffuser plate 70, an aeration spray assembly 200, and a pulsating spray assembly 300. The outer, rigid components of the preferred embodiment of the showerhead 5 are preferably molded from high-impact ABS plastic or Delrin™ acetal. One skilled in the art may substitute other materials for the components described below without departing from the invention described herein. However, such materials should be suitable for conduct with potable water under F.D.A. requirements.

The shell 10 has an inlet end 12 and an outlet end 14 spaced from the inlet end 12. The inlet end 12 has a threaded central bore 13 that is adapted to receive a swivel ball fitting 15. The swivel ball fitting 15 has a connecting end 16 opposite a ball portion 18, and a central throughgoing passage 17 to allow water to flow through the swivel ball fitting 15. The connecting end 16 is adapted to be threadably connected to a water supply 19. The outlet end 14 of the shell 10 is adapted to receive the selector housing 20.

The selector housing 20 has an inlet end 22 and an outlet end 24 spaced from the inlet end 22. The inlet end 22 has a central stem 23 that is positioned inside the outlet end 14 of the shell 10 and is threadably mounted inside the central bore 13 of the inlet end 14 of the shell 10. The central stem 23 holds the swivel ball fitting 15 in place. The central stem 23 also has a central bore 26 aligned with and in fluid communication with the central throughgoing passage 17 of the swivel ball fitting 15. The outlet end 24 of the selector housing 20 is open to receive the selector disk 30, the selector face 50, the diffuser plate 70, the aeration spray assembly 200, and the pulsating spray assembly 300. The selector housing 20 is thus of a cupped shape having threads 28 along its inner surface. The inner surface of the housing 20 additionally includes three axially extending slots 29 molded transversely into the threads 28. The slots 29 are sized to receive projecting tabs (referred to below) on the various assemblies in order to facilitate alignment of the assemblies. Because each of the three slots 29 are of different widths, only a single orientation of the various assemblies and components within the housing 20 is allowed.

The selector disk 30 is removably and rotatably mounted inside the selector housing 20 near the inlet end 22. The selector disk 30 defines an axially throughgoing hole 36 to allow water to flow through the selector disk 30. The axially throughgoing hole 36 is radially spaced from the center 31 of the selector disk 30.

Figure 4A:
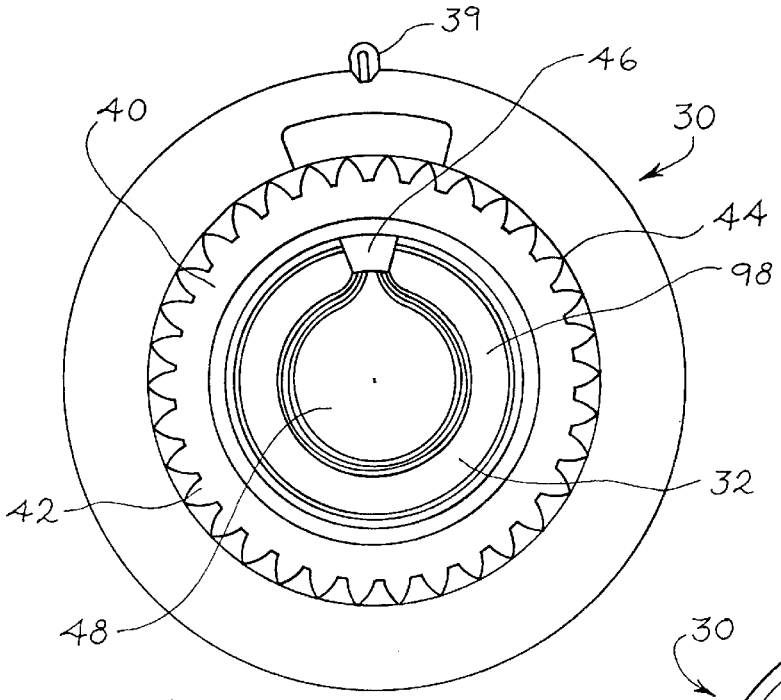
FIG. 4A is a rear view of the selector disk of the first preferred embodiment of the present invention.
Figure 4B:
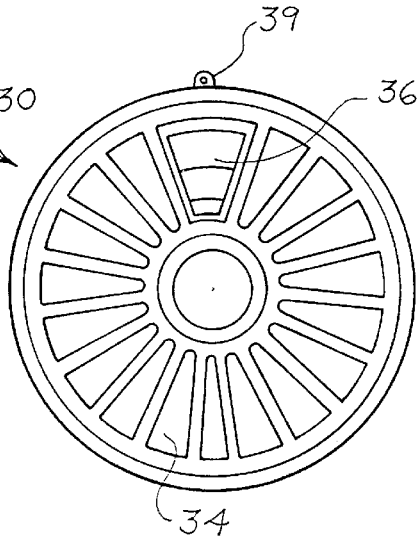
FIG. 4B is a front view of the selector disk of the first preferred embodiment of the present invention.
Figure 4C:
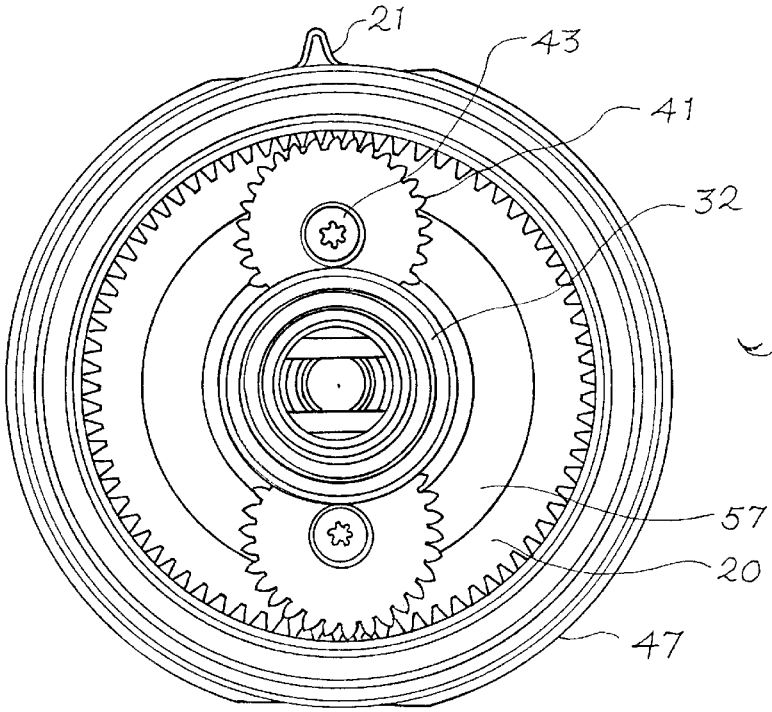
FIG. 4C is a partial assembly drawing showing the selector assembly of the first preferred embodiment of the present invention.

The selector disk 30 is molded with a hollow stem 40 projecting from the inlet end 32 of the selector disk 30, as shown in more detail in FIGS. 4A and 4B. The stem 40 has a plurality of gear teeth 44 projecting radially outwardly from an end 42 of the stem 40. The hollow stem 40 has an opening 48 in the end 42 that is in fluid communication and alignment with the central bore 26 of the selector housing 20. This relationship can be seen in FIG. 4C. The bore 26 also contains a peripheral lip 98 projecting radially inwardly into bore 26 from the walls of the stem 40. The stem 40 also has at least one transverse aperture 46 connected to the axially throughgoing hole 36 to allow water to flow from inside the hollow stem 40 through to the axially throughgoing hole 36 and through the outlet end 34 of the selector disk 30.

The selector disk 30 is mounted within the selector housing 20, and allowed to freely rotate within the housing 20. Specifically, the hollow stem 40 of the selector disk 30 is received within the stem receiving portion 27 of the central bore 26 of selector housing 20. Compressed between an end of the stem receiving portion 27 and the peripheral lip 98 is a metal spring 89. The spring forces the overlying selector disk 30 against the selector face 50 as described further below. In order to prevent leakage between the selector housing bore 26 and the end 42 of the selector disk 30, an elastomeric O-ring 77 is interposed between end 42 and the end of stem receiving portion 27. Another O-ring 79 is placed in groove 79*a* on the stem 40 in order to provide a seal between the stem 40 and the interior of the selector housing 20. The selector disk also includes a stop pin 39 projecting from the circumferential edge of the disk 30.

With the selector disk stem 40 mounted within the stem receiving portion 27 of the selector housing 20, radial portions of the gear teeth 44 on the stem 40 are exposed through a pair of transverse apertures 23*a* on the stem 23 of the housing 20. The exposed teeth 44 mesh with idler gears 41 adjacent each of the apertures 23*a*. The idler gears 41 each include gear teeth on a upper portion 41*a* and a lower portion 41*b*. The idler gears 41 are mounted to the selector housing on raised lands 58 molded into the rear face 57 of the selector housing 20. The idler gears 41 are secured by metal screws 43 inserted axially through each idler gear and through a threaded bore 45 within each raised land 58. A lower portion 41*b* of the idler gears mesh with the teeth 44 projecting through the transverse apertures 23*a*.

The upper portions 41*a* of the idler gears 41 are of larger diameter than the lower portions 41*b* and interface with selector ring 47 which is fitted around the outside of the selector housing 20. As can be seen in FIG. 3A, the selector ring is a molded cylindrical member with an interior surface 49 and exterior surface 53. The upper portion of the interior surface 55 includes gear teeth 55 projecting radially inward. The exterior surface 53 contains longitudinally extending ridges 59. The selector ring 47 is fitted over the selector housing 20 and idler gears 41. The upper portions 41*a* of the idler gears mesh with the teeth 55 on the interior surface 49 of the selector ring, and an interior peripheral lip 49*a* on the selector ring 47 prevents the ring 47 from slipping completely over the selector housing 20. When the selector ring 47 is rotated, the gear teeth 55 rotate idler gears 41, which in turn rotate the stem 40 of the selector disk 30. To facilitate turning of the selector ring 47, an elastomeric gripper ring 21 is provided to fit externally on the selector ring 47 and comprises a portion of the outside of the showerhead 5. Axial, raised ridges 59 on the selector ring 47 register with grooves 833 on the interior of the gripper 21. Finally, circumferential wavy ridges 25 on gripper 21 facilitate grasping and turning of the selector ring 47 by a user's wet hands.

The selector disk 30 is held in place within the selector housing 20 by the selector face 50 and the remaining overlying assemblies. As shown in FIG. 3A, the selector face 50 is removably fitted inside the selector housing 20. The selector face 50 includes a circular upstanding wall 55 upstanding from its outlet end 54. Three tabs 57 project radially from the wall 55, and register with slots 29 on the interior of the selector housing 20. The selector face 50 has a flat-surfaced inlet end 52 that is held flush against the flat surface of the outlet end 34 of the selector disk 30, an outlet end 54 opposite the inlet end 52 of the selector face 50, and a center 51. An elastomeric gasket, preferably made from EPDM rubber, is positioned between the inlet end 52 of the selector face 50 and the outlet end 34 of the selector disk 30 in order to provide an improved seal between the selector face 50 and the selector disk 30.

The inlet end 52 of the selector face 50 includes an upstanding circular ridge 37. The circular ridge conforms to the edge of the circular outlet end of the selector disk 30. In the preferred embodiment, the ridge 37 defines a circular area having a diameter of 1.795 inches. Thus, the selector disk 30 is rotatable within the circular area defined by the ridge 37. Projecting from the ridge 37 are a pair of stops 35 which limit the rotation of the selector disk 30 to an arc of slightly more than 180°. The stops 35 are upstanding further from the ridge 37, and prevent further turning of the selector disk 30 by interrupting the movement of the stop pin 39 on the edge of the outlet end 34 of the selector disk 30. The ridge 37 also contains several depressions 59 which register slight friction with the stop pin 39. This "clicking" action gives the user tactile feedback indicating that the showerhead 5 is properly set at a particular mode of operation.

The selector face 50 also has a plurality of axially throughgoing selector holes 60 to allow water to flow through the selector face 50. The axially throughgoing selector holes 60 are radially spaced from the center 51 along the same arc of the selector face 50 and are capable of alignment and fluid communication with the axially throughgoing hole 36 of the selector disk 30. The alignment of the axially throughgoing selector holes 60 and the axially throughgoing hole 36 depends on the rotational position of the selector disk 30. The axially throughgoing selector holes 60 are sized and spaced from one another such that the axially throughgoing hole 36 may be aligned with up to two selector holes 60 at once. Each of the selector holes 60 has an approximate square shape.

Figure 5A:
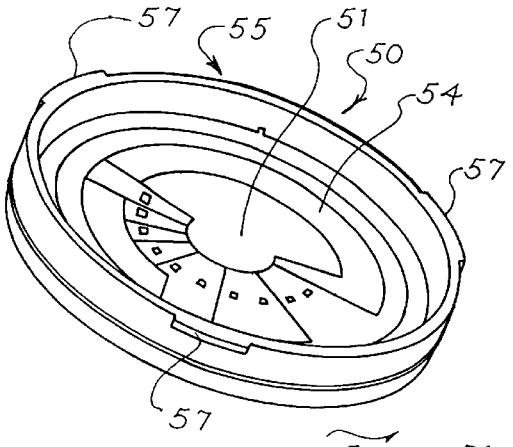
FIG. 5A is a perspective view of the rear of the selector face of the first preferred embodiment of the present invention.
Figure 5B:
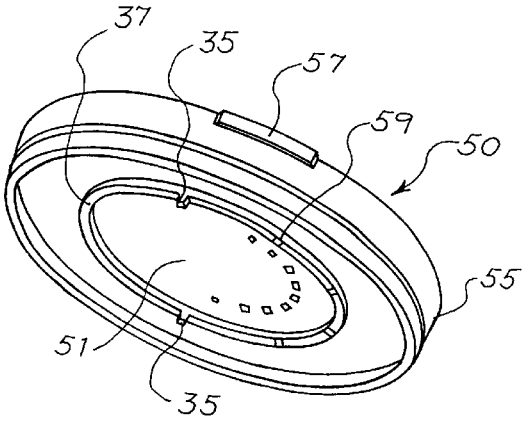
FIG. 5B is another perspective view of the front of the selector face of the first preferred embodiment of the present invention.
Figure 5C:
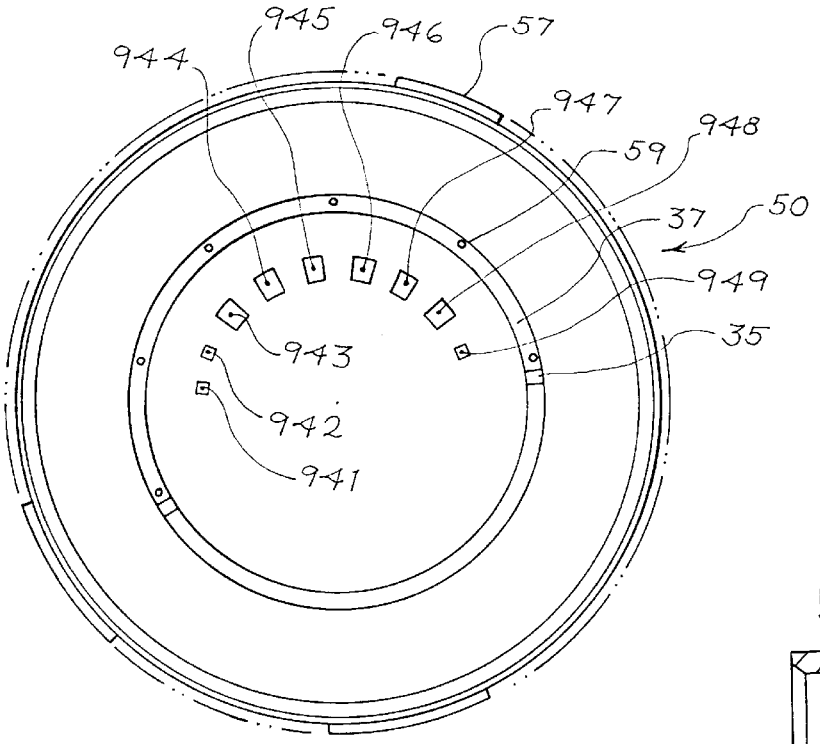
FIG. 5C is a front view of the selector face of FIGS. 5A and 5B.

Preferably, the plurality of selector holes 60 are radially spaced from the center 51 of the selector face 50 at the same distance. In the preferred embodiment, the holes 60 are spaced between 0.60 and 0.65 inches from the center 51. As a result, the plurality of selector holes 60 preferably form an arc around the center 51 of the selector face 50 as shown in FIG. 5C. Preferably, there are nine axially throughgoing selector holes 60 around the center 51 of the selector face 50. In particular, the selector face 50 defines aeration spray selector holes 948 and 949, inside spray ring selector holes 946 and 947, outside spray ring selector holes 944 and 945, and pulsating spray selector holes 941, 942 and 943. Holes 941 and 942 are preferably smaller than 943 to partially restrict water flow. Hole 949 is reduced in size as well. The holes may vary in size slightly to correspondingly vary the water throughput for each hole and its associated spray orifice. In the preferred embodiment, each of the ten holes are separated by an angle of 19.29 degrees.

As shown in FIGS. 6A–6E, the diffuser plate 70 is fitted inside the selector housing 20, again oriented by projecting tabs 99 which align with slots 29 in selector housing 20. The diffuser plate 70 has an inlet end 72 that is flush against the outlet end 54 of the selector face 50, an outlet end 74 opposite the inlet end 72 of the diffuser plate 70, and a center 71. The outlet end 74 of the diffuser plate 70 has an upstanding aeration spray assembly mounting cup 76 for mounting the aeration spray assembly 200, and an upstanding pulsating spray assembly mounting cup 78 for mounting the pulsating spray assembly 300. An elastomeric gasket 96 may be positioned between the inlet end 72 of the diffuser plate 70 and the outlet end 54 of the selector face 50 in order to provide an improved seal between the diffuser plate 70 and the selector face 50.

The diffuser plate 70 preferably has several channels 80 defined by upstanding walls on the inlet end 72, and several axially throughgoing exit holes 90 to connect the channels 80 to the outlet end 74 of the diffuser plate 70. The channels 80 are in fluid communication with at least one of the axially throughgoing selector holes 60 in selector face 50, and the axially throughgoing exit holes 90 allow water to flow from the channels 80 out through the outlet end 74 of the diffuser plate 70. In the preferred embodiment, the channels are approximately 0.133 inches deep.

Preferably, the channels 80 in diffuser plate 70 include an aeration spray channel 82, a pair of inside spray ring channels 83, an outside spray ring channel 84, and three pulsating spray channels 85*a*, 85*b*, 85*c*.

Figure 6F:
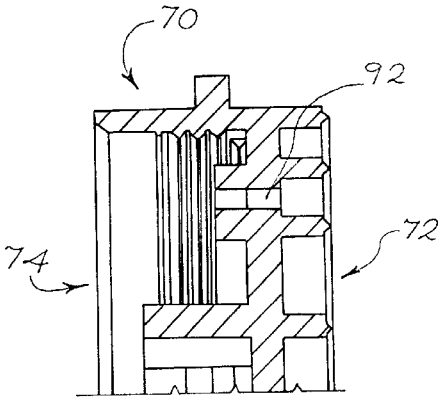
FIG. 6F is a cross-sectional view of a portion of the diffuser plate of FIG. 6A.
Figure 6A:
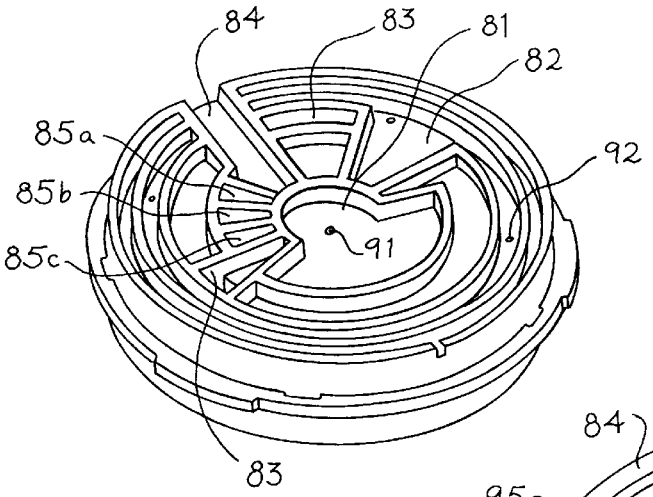
FIG. 6A is a perspective view of the diffuser plate of the first preferred embodiment of the present invention.
Figure 6D:
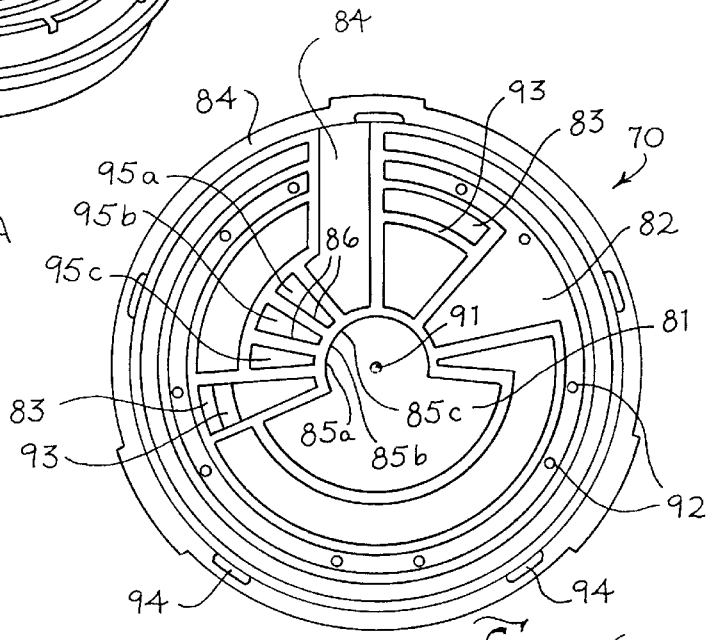
FIG. 6D is a rear view of the diffuser plate of FIG. 6A.
Figure 6C:
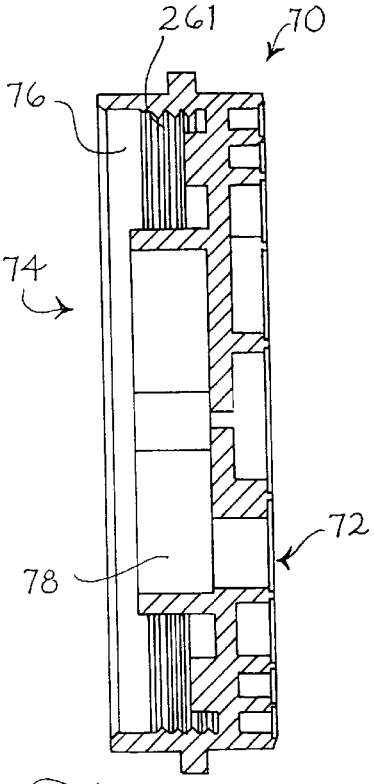
FIG. 6C is a cross-sectional view taken along line 6—6 of the diffuser plate of FIG. 6B.

The aeration spray channel 82 is in fluid communication with the aeration spray selector holes 948, 949 of the selector face 50. The aeration spray channel 82 has at least one axially throughgoing exit hole 92 to allow water to flow out of the outlet end 74 of the diffuser plate 70 and to the aeration spray assembly 200. Preferably, there are nine axially throughgoing circular exit holes 92 radially disposed at the same distance from the center 71 of the diffuser plate 70. As shown in FIG. 6F, each exit hole 92 preferably tapers from slightly larger diameter to a slightly smaller diameter as the holes 92 each progress through the diffuser plate 70. Thus, the diameter at the inlet end 72 is slightly larger than the diameter at the outlet end 74 of the diffuser plate 70 for each of the holes 92. In the preferred embodiment, the diameter at the inlet end of hole 92 is approximately 0.055 inches, while the diameter at the outlet end is approximately 0.047 inches. This light taper creates a small venturi effect to accelerate the water slightly from the inlet end through holes 92 and out the outlet end 74 of the diffuser plate 70.

The inside spray ring channels 83 are in fluid communication with the inside spray ring selector holes 946 and 947 of the selector face 50. Each inside spray ring channel 83 has at least one axially throughgoing exit hole 93 to allow water to flow out of the outlet end 74 of the diffuser plate 70 and to the inside spray ring 420. Preferably, the axially throughgoing exit holes 93 are an elongated slot.

The outside spray ring channel 84 is in fluid communication with the outside spray ring selector holes 944 and 945 of the selector face 50. The outside spray ring channel 84 has at least one axially throughgoing exit hole 94 to allow water to flow out of the outlet end 74 of the diffuser plate 70 and to the outside spray ring 440.

The pulsating spray channels 85*c*, 85*b*, 85*a* are in fluid communication with the pulsating spray selector holes 941, 942, 943 of the selector face 50 respectively. Each pulsating spray channel 85*a*, 85*b*, 85*c* has at least one axially throughgoing exit hole 95*a*, 95*b*, 95*c*, respectively, to allow water to flow out of the outlet end 74 of the diffuser plate 70 and to the pulsating spray assembly 300. Preferably, there are three axially throughgoing exit holes 95*a*, 95*b*, 95*c* as with dividers 86 splitting the pulsating spray channels 85*a*, 85*b*, 85*c* into their respective channels to provide variations of slow and fast water flow to the pulsating spray assembly 300.

As shown in FIG. 2, the aeration spray assembly 200 is threadably mounted to the outlet end 74 of the diffuser plate 70. The aeration spray assembly 200 has a central aperture 204 that is adapted to receive the pulsating spray assembly 300 and inner spray ring 420. The aeration spray assembly 200 includes an aeration ring 210 and a mixing chamber 240.

The aeration ring 210 is shown in more detail in FIGS. 7A–E. As shown in the figures, the aeration ring 210 has an inlet end 212 that is threadably mounted via threads 260 to the threads 261 on the aeration spray assembly mount cup 76 on the outlet end 74 of the diffuser plate 70. The aeration ring 210 also has an outlet end 214 spaced from and opposite to the inlet end 212 of the aeration ring 210.

Preferably, the aeration ring 210 also has a slot 211 around its entire circumference on its outer edge between the inlet end 212 and the outlet end 214 of the aeration ring 210. The slot 211 is adapted to receive the outside spray ring 440 and help hold it in place.

Furthermore, the aeration ring 210 preferably has ten aerated spray nozzles 220 running from the inlet end 212 to the outlet end 214 of the aeration ring 210. The nozzles 220 are radially disposed around the circumference of the aeration ring 210 and aligned with the ten axially throughgoing exit holes 92 of the aeration spray channel 82 shown in FIGS. 2 and 6B. The nozzle 220 is shown in detail in FIG. 7D. Each aerated spray nozzle 220 has an inlet port 222 at the inlet end 212, an outlet port 224 at the outlet end 214, and an intermediate port 226 between the inlet port 222 and the outlet port 224. The inlet port 222 has an inlet diameter 223, the outlet port has an outlet diameter 225, and the intermediate port 226 has an intermediate diameter 227. The intermediate diameter 227 is smaller than both the inlet diameter 223 and the outlet diameter 225, and tapered portion 275 transitions between the inlet port 222 and intermediate port 226. This arrangement provides a venturi nozzle configuration for the aerated spray nozzles 220. As a result of this configuration, the flow rate of water through the aerated spray nozzle 220 is increased. In the preferred embodiment, the diameter of the inlet port 222 is approximately 0.188 inches, which is equivalent to the diameter of the outlet port 224. The intermediate port 226 in the preferred embodiment has a diameter of approximately 0.094 inches. The tapered portion 275 is angled at approximately 43.4 degrees from the axial center of the nozzle 220.

The inlet port 222 of each aerated spray nozzle 220 is preferably capped with a metal mesh screen 221. In the preferred embodiment, the mesh screen 221 is made from 0.0065 stainless steel wire of 60 mesh with a 0.012 inch opening. Some of the water forced from the aerated spray exit holes 92 and toward the aerated spray nozzles 220 is thus encouraged by the metal mesh 221 to become turbulent and fill the mixing chamber 240.

Figure 7A:
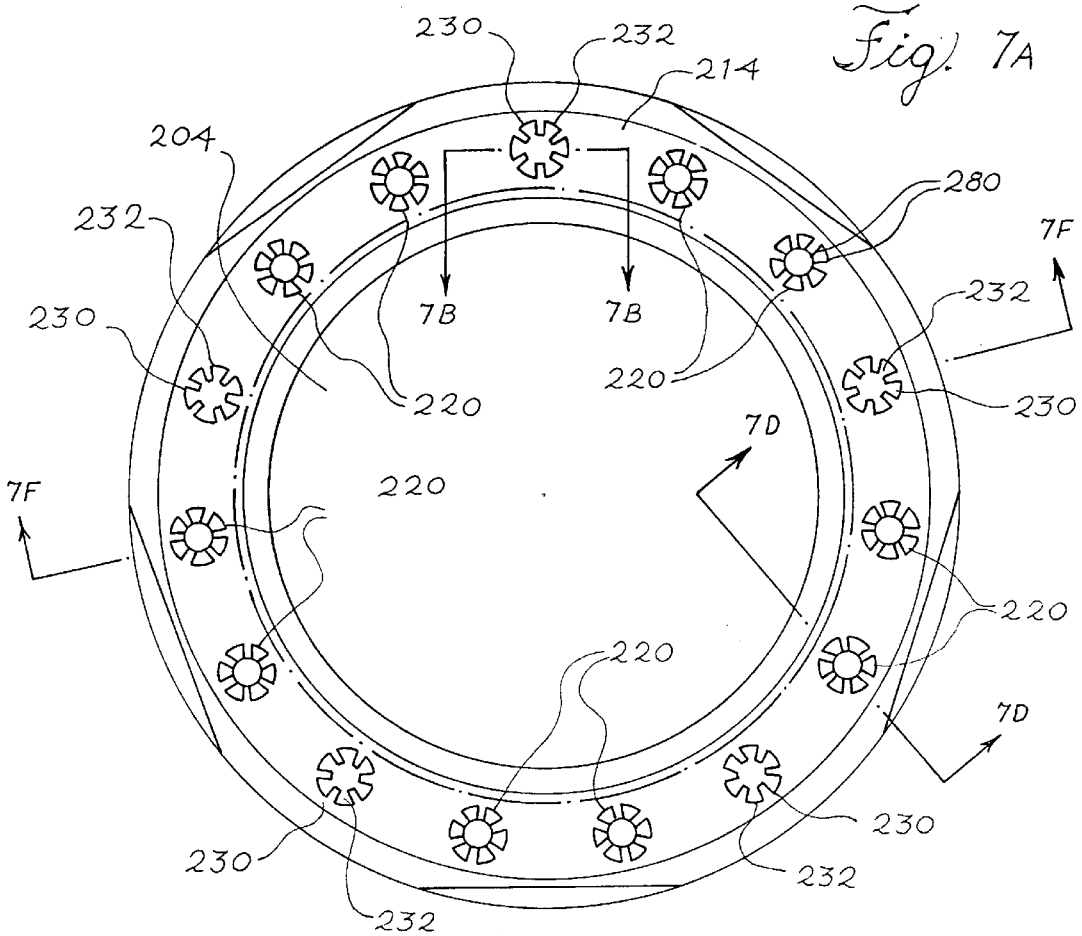
FIG. 7A is a front view of the aeration ring in the first preferred embodiment of the present invention.
Figure 7C:
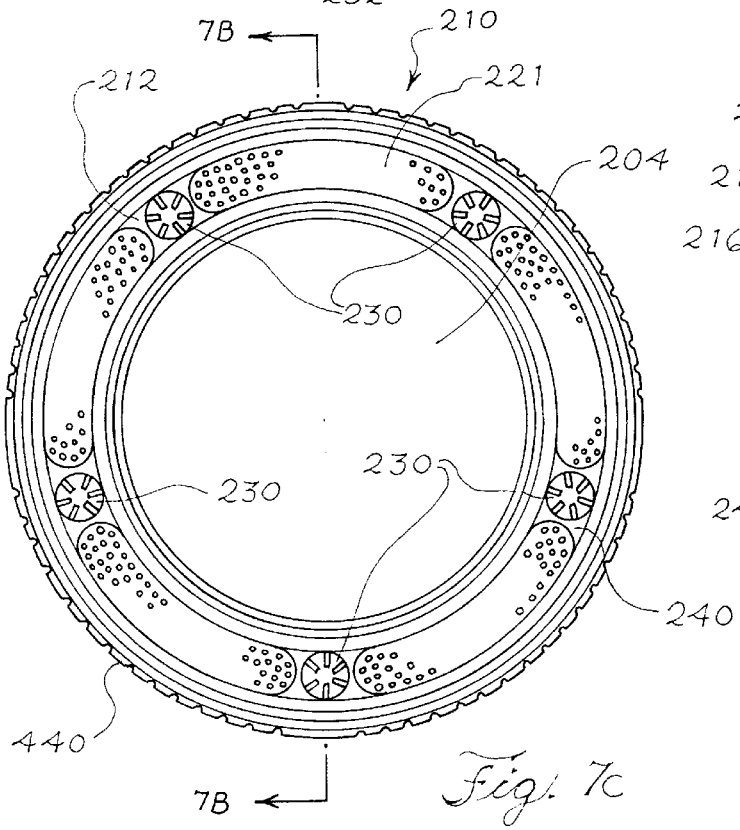
FIG. 7C is a rear view of the aeration ring of FIG. 7A.
Figure 7B:
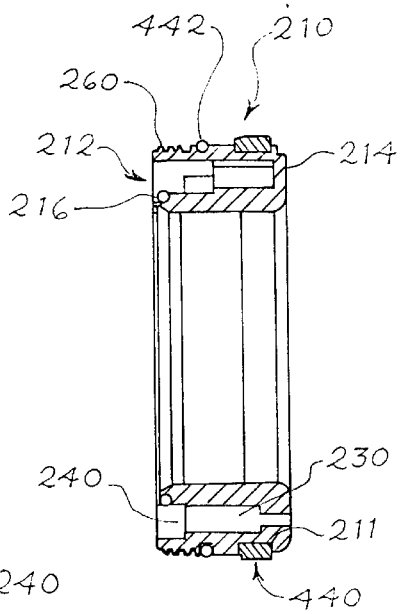
FIG. 7B is a cross-sectional view of the aeration ring of FIG. 7A taken along line 7—7.
Figure 7D:
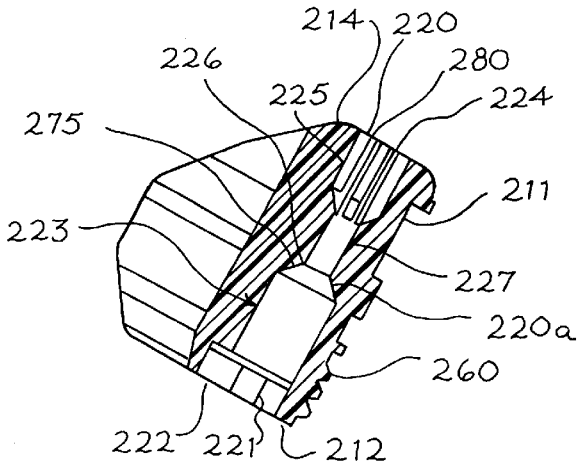
FIG. 7D is a cross-sectional view of an aeration nozzle taken along line D—D in FIG. 7A.
Figure 8C:
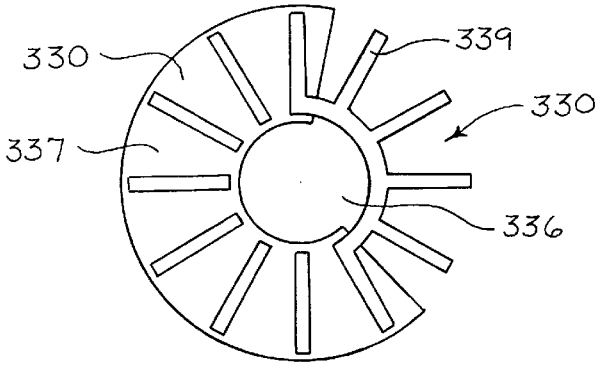
FIG. 8C is a top view of the rotary turbine of FIG. 8A.
Figure 7E:
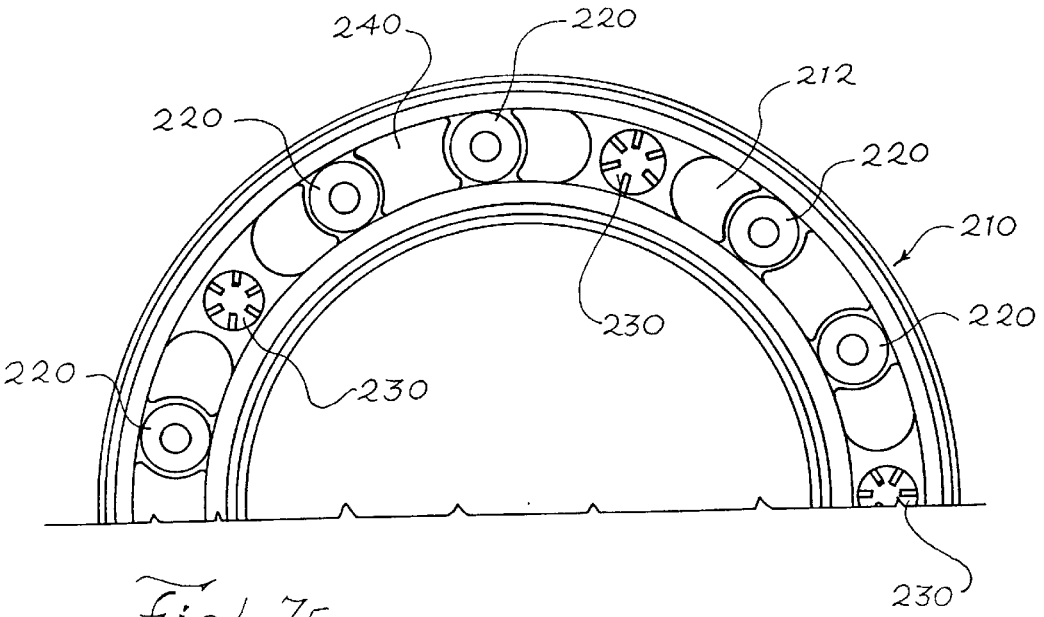
FIG. 7E is a rear view of the aeration ring of FIG. 7A with certain parts removed for clarity.

In addition to the aerated spray nozzle 220, the aeration ring 210 preferably has five air intake apertures 230 running from the inlet end 212 to the outlet end 214 of the aeration ring 210. Preferably, there are five air intake apertures 230 radially disposed around the circumference of the aeration ring 210, as shown in FIG. 7A. Each air intake aperture 230 has an inlet port 232 at the outlet end 214 and an outlet port 234 at the inlet end 212 of the aeration ring 210. The air intake apertures 230 preferably have the same diameter from the inlet port 232 to the outlet port 234. Air is drawn through the air intake apertures 230 by slight vacuum pressure caused by the accelerated exit of water from the mixing chamber 240 and out the aerated spray nozzles 220. Finally, each nozzle 220 has at its outlet port 224 a group of six elongated fins 280 radially spaced at the port 224. These fins assist in directing the aerated water in a straight stream.

The aerated spray nozzles 220 and the air intake apertures 230 are connected by the mixing chamber 240 radially disposed between the inlet end 212 of the aeration ring 210 and the outlet end 74 of the diffuser plate 70. The air that is drawn through the air intake apertures 230 from the front of the showerhead 5 is mixed in the mixing chamber 240 with the water that flows into the chamber 240 from the outlet end 74 of the diffuser plate 70. The mixture of air and water then flows from the mixing chamber 240 into the inlet port 222 of the aerated spray nozzles 220, and out the outlet port 224 of the aerated spray nozzles 220.

As shown in FIGS. 2, 3A and 8A–C, the pulsating spray assembly 300 is mounted to the outlet end 74 of the diffuser plate 70 within the central aperture 204 of the aeration spray assembly 200. The pulsating spray assembly 300 comprises a turbine cup 310, a rotary turbine 330, and a propulsion disk 340.

The turbine cup 310 has an inlet end 312 mounted to the outlet end 74 of the diffuser plate 70. In particular, the inlet end 312 of the turbine cup 310 is sonically welded onto the pulsating spray assembly mounting cup 78 on the outlet end 74 of the diffuser plate 70.

The turbine cup 310 also has an outlet end 314 spaced from and opposite to the inlet end 312. The outlet end 314 has a flat interior bottom 316 and a plurality of axially throughgoing outlet holes 318 arranged in three groups of six holes 318. The axially throughgoing outlet holes 318 allow water to flow through the outlet end 314 of the turbine cup 310 and out to a user of the showerhead 5. A cylindrical central post 320 upstands from the bottom 316 of the cup 310.

Preferably, the turbine cup 310 also has a slot 311 around its entire circumference on its outer edge 309 between the inlet end 312 and the outlet end 314 of the turbine cup 310. The slot 311 is adapted to receive the inside spray ring 420 and hold it in place on the outer edge 309.

As shown in FIG. 2, the rotary turbine 330 is disposed inside of the turbine cup 310 around the central post 320. The rotary turbine 330 has a central bore 336 that is adapted to receive the central post 320 of the turbine cup 310. This arrangement allows the rotary turbine 330 to freely rotate about the central post 320. The rotary turbine 330 also has an inlet end 332 near the inlet end 312 of the turbine cup 310, and an outlet end 334 facing the bottom 316 of the outlet end 314 of the turbine cup 310, as shown in FIGS. 3A and 8A–C.

A valving projection 337 partially covers the outlet end 334 of the rotary turbine 330. The valving projection 337 prevents water from flowing through the outlet end 334 of the rotary turbine 330. In addition, the valving projection 337 blocks some of the throughgoing exit holes 318 in the outlet end 314 of the turbine cup 310 during the rotation of the turbine 330. Preferably, the valving projection 337 has a small groove 338 radially disposed on the side of the valving projection 337 facing the bottom 316 of the turbine cup 310. The groove 338 has a depth of approximately 0.06 inches and has a width between a 1.1 inch and a 0.915 inch diameter. The groove 338 prevents stalling of the rotary turbine 330 by allowing water to flow between the valving projection 337 and the bottom 316 of the turbine cup 310. An additional groove 351 is preferably formed on the projection 337 at the periphery of the central bore 336. Accordingly, the valving projection 337 and the rotary turbine 330 are forced away from the bottom 316 of the turbine cup 310 by the water flowing in the grooves 338 and 351, and the rotary turbine 330 is free to spin within the turbine cup 310 around the central post 320.

In addition to the valving projection 337, the rotary turbine 330 has a plurality of impellers 339. The impellers 339 drive the rotary turbine 330 in rotation when they come into contact with water.

Figure 6E:
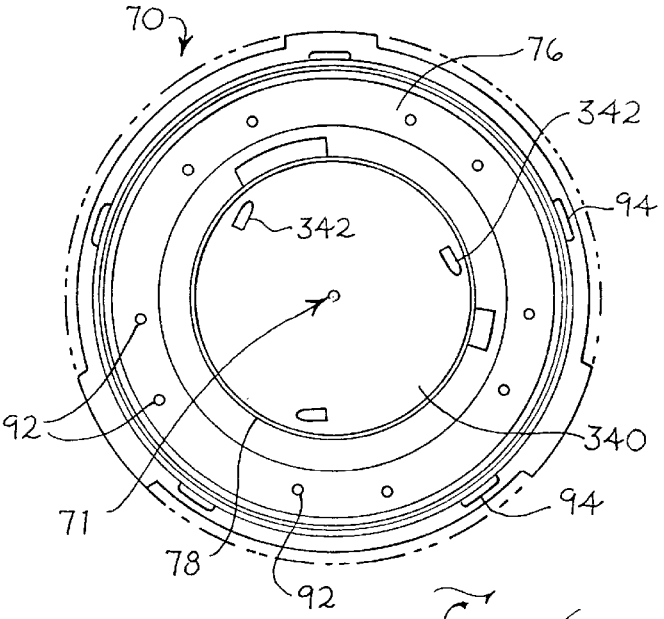
FIG. 6E is a front view of the diffuser plate of FIG. 6A with a propulsion disk attached thereto.
Figure 6B:
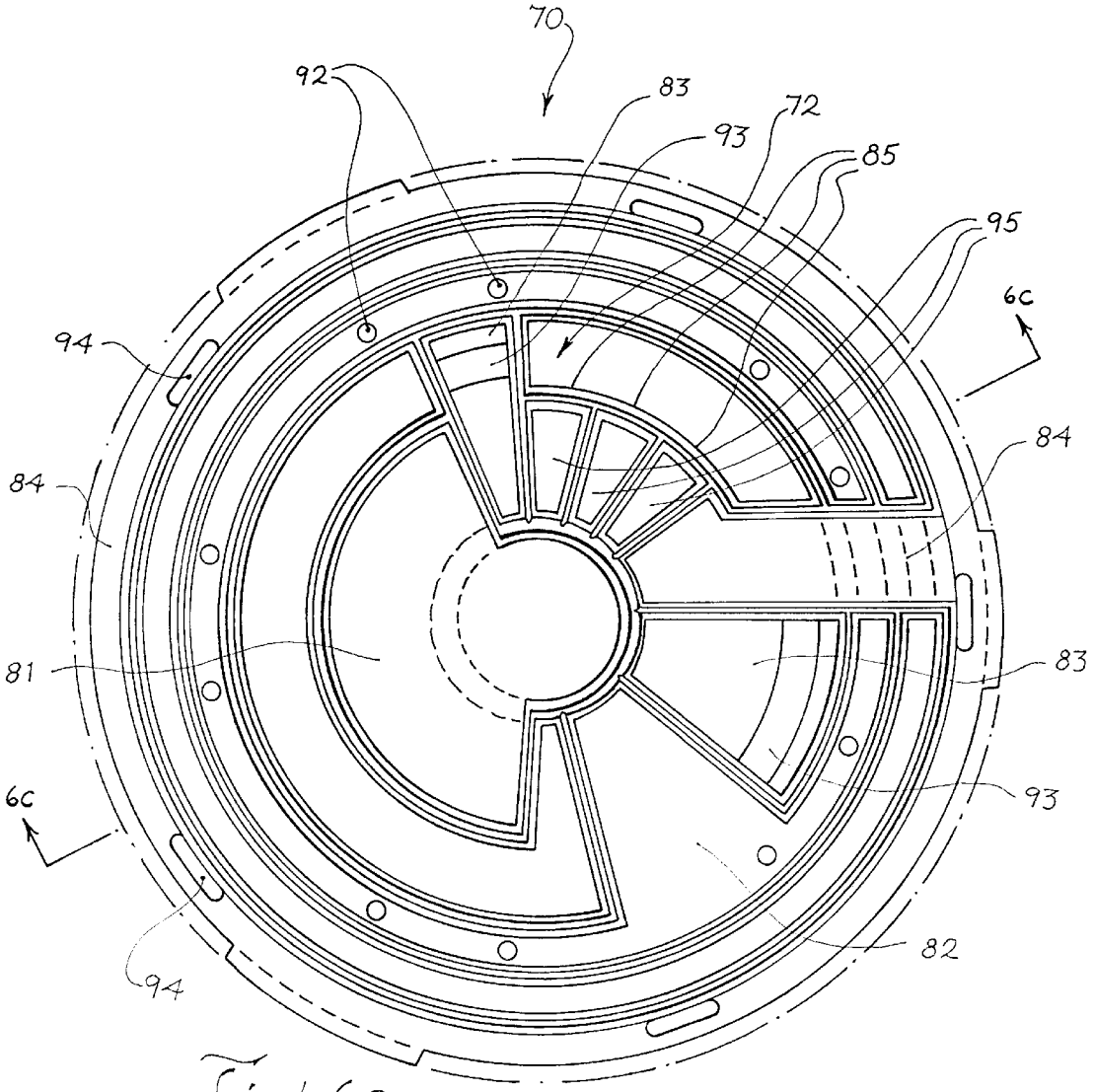
FIG. 6B is a rear view of the diffuser plate of FIG. 6A.
Figure 8A:
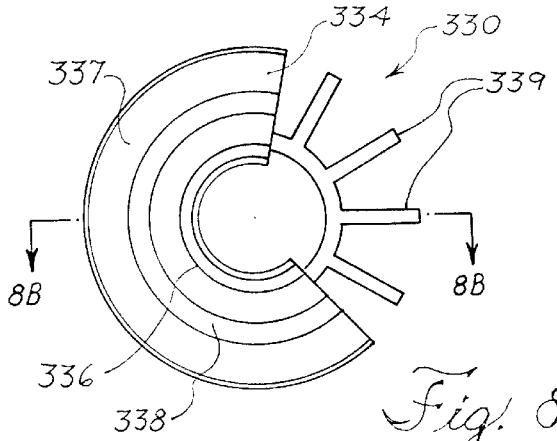
FIG. 8A is a bottom view of the rotary turbine in the first preferred embodiment of the present invention.
Figure 8B:
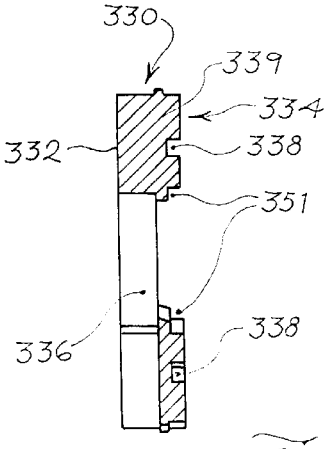
FIG. 8B is a cross-sectional view of the rotary turbine of FIG. 8A taken along line B—B.

As shown in FIGS. 2 and 6E, the pulsating spray assembly 300 also includes a propulsion disk 340 disposed on the inlet end 312 of the turbine cup 310 between the turbine cup 310 and the pulsating spray assembly mounting cup 78 on the outlet end 74 of the diffuser plate 70. The propulsion disk 340 is held into place by sonic-weld mounting of the inlet end 312 of the turbine cup 310 on the pulsating spray assembly mounting cup 78. The propulsion disk 340 preferably has three partially transverse throughgoing nozzles 342 to allow water to flow through the cover plate and into the turbine cup 310. These nozzles 342 are oriented to force the water to flow in a partially transverse, circular direction within the turbine cup 310. As a result, the swirling water drives the impellers 338 of the rotary turbine 330, rotating the turbine around the center post 320.

The pulsating spray assembly 300 operates as follows. Water is directed through the selector disk 30 and one of the axially throughgoing holes 941, 942 and 943 in the selector face 50. This in turn fills one or more of the pulsating spray channels 85*a*, 85*b*, 85*c* in diffuser plate 70. Water is then directed through the diffuser plate 70 to fill the cup 78 via one or more of the corresponding exit holes 95*a*, 95*b*, 95*c*. As the cup 78 fills, water is forced against the propulsion disk 340 of the pulsating spray assembly 300. The pressurized water is forced through the three transverse throughgoing nozzles 342 and into the turbine cup 310. The moving water forces the turbine 340 within the turbine cup 310 to rotate around the central post 320. As the rotary turbine 330 spins, water fills the inside of the cup 310 and exits through the outlet holes 318 that are not covered by the valving projection 337 on the bottom 316 of the cup 310. As the turbine 330, and thus the valving projection 337, cover and uncover successive outlets 318, pulsating jets of water from the cup 310 are created.

Figure 3C:
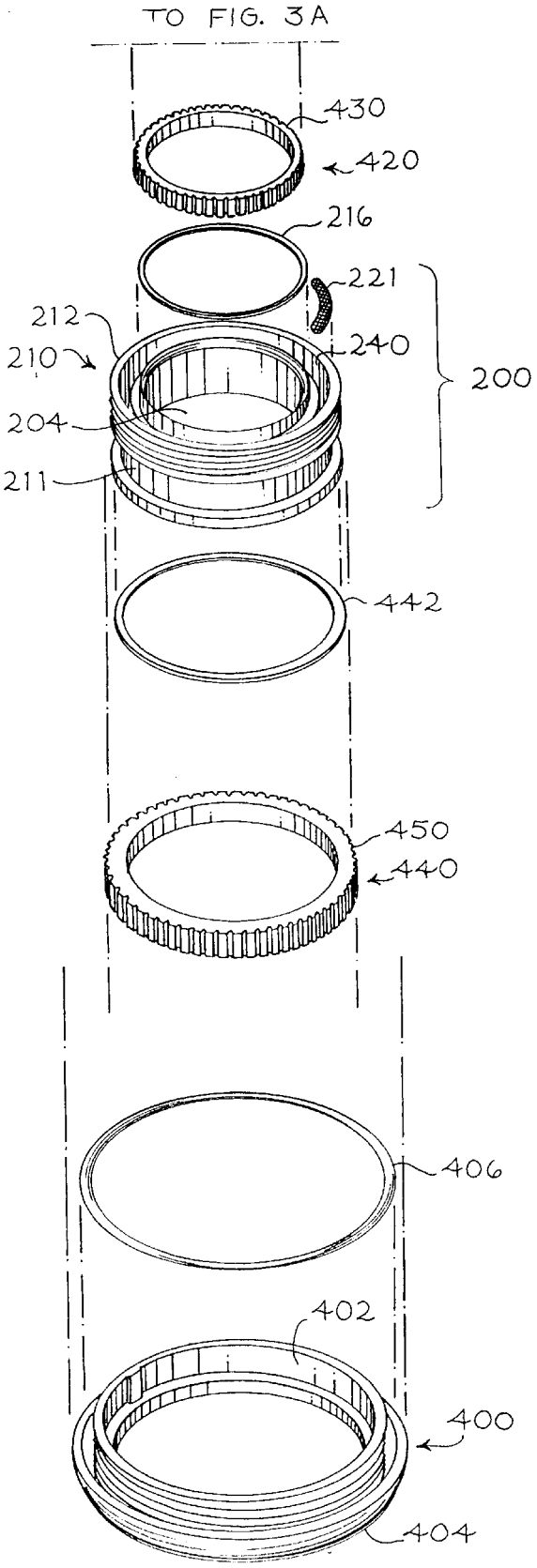
FIG. 3C is a continuation of the assembly drawing of FIG. 3A.
Figure 3B:
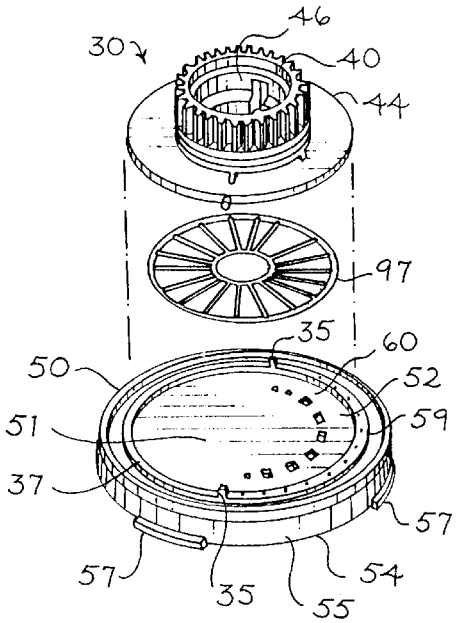
FIG. 3B is an exploded detailed drawing of a portion of FIG. 3A.

As shown in FIG. 3C, the showerhead of the preferred embodiment has a collar 400 threadably mounted inside the outlet end 24 of the selector housing 20 and radially disposed around the aeration spray assembly 200. The collar has an inner wall 402 and is used, in part, to hold the outside spray ring in place against the aeration ring 210.

As shown in FIGS. 9A–E, the outside spray ring 440 is removably mounted between the collar 400 and the aeration spray assembly 200. Preferably, the outside spray ring 440 is disposed in the slot 211 of the aeration ring 210 to hold it in place. The outside spray ring 440 is preferably molded from Santoprene™, or an elastomeric material such as rubber or plastic and has a plurality of grooves 450 formed around its circumference on its outer edge. In the preferred embodiment, the grooves are spaced 4.737 degrees apart. In order to provide a showerhead user with thorough coverage from water exiting the outside spray ring 440, the grooves 450 are formed in the ring such that they vary slightly in angle, as seen in FIGS. 9A–9E. In particular, each groove is cut to one of four tapering depth angles as indicated in FIGS.

Figure 9B:
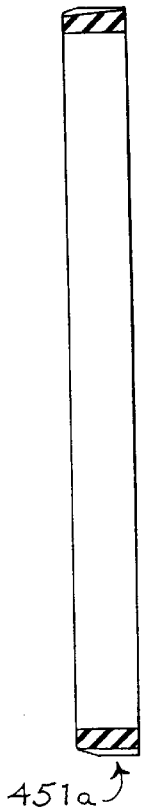
FIGS. 9B, 9C, 9D and 9E are cross-sectional views of the ring of FIG. 9A.
Figure 9C:
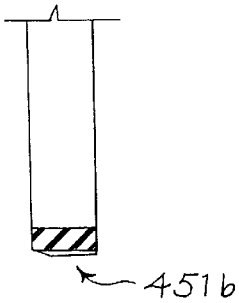
Figure 9D:
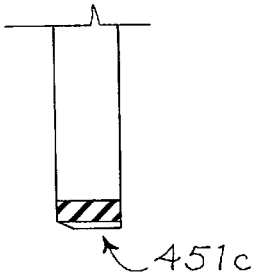
Figure 9E:
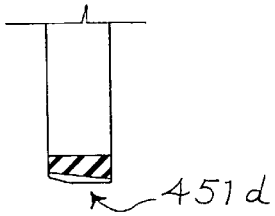
Figure 9A:
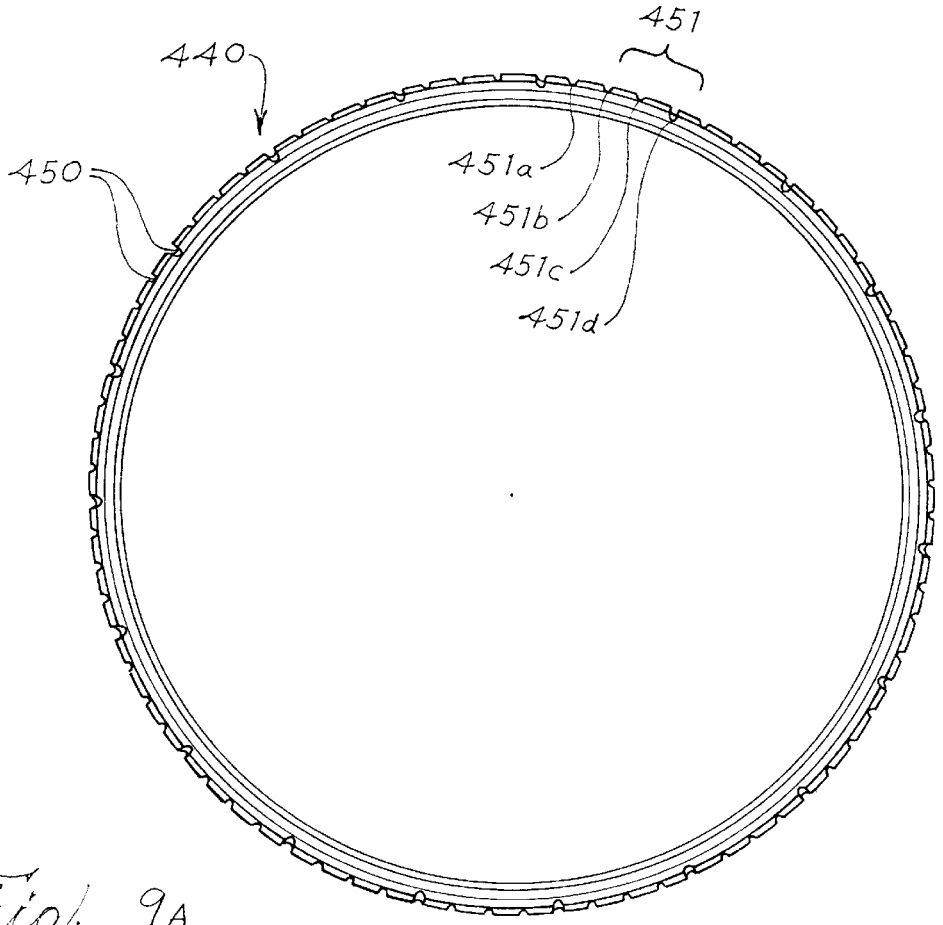
FIG. 9A is a front view of the outer spray ring of the first preferred embodiment of the present invention.

9B–9E. In the preferred embodiment, each of the angles 451*a*, 451*b*, 451*c*, and 451*d* vary with respect to the axial direction perpendicular to the plane defined by the circular ring 440. In particular, groove 451*a* is cut to an angle of 0.015 degrees from the throughgoing axis, angle 451*b* is 1.15 degrees, angle 451*c* is 4.00 degrees, and angle 451*d* is 6.84 degrees. The sequence of four progressing depths 451 is repeated around the entire circumference of the outside spray ring 440, as shown in FIG. 9A. When the outside spray ring 440 is secured using collar 400, the grooves 450 are covered by the inner wall 402 of the collar 400 to form orifices 455.

Figure 10A:
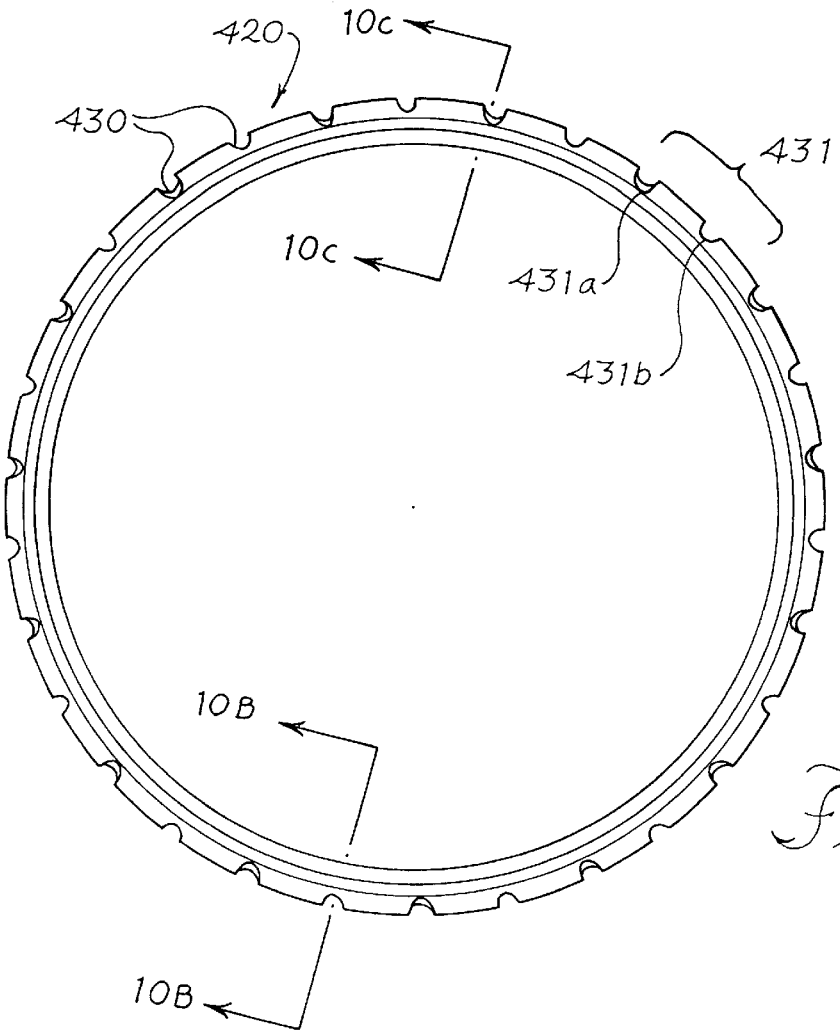
FIG. 10A is a front view of the inner spray ring of the first preferred embodiment of the present invention.
Figure 10B:
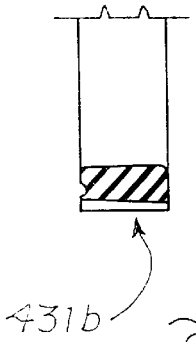
FIGS. 10B and 10C show cross-sectional views of the ring of FIG. 10A.
Figure 10C:
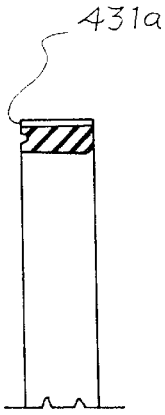

Referring now to FIGS. 10A–C, the inside spray ring 420 is removably mounted between the pulsating spray assembly 300 and the aeration spray assembly 200. Preferably, the inside spray ring 420 is disposed in the slot 311 of the turbine cup 310 to hold it in place. The inside spray ring 420 is preferably made of the same elastomeric material as outside spray ring 440, and has a plurality of grooves 430 formed around its circumference on its outer edge. In the preferred embodiment, the grooves are spaced 12.0 degrees apart. In order to provide a showerhead user with thorough coverage from water exiting the inside spray ring 420, the grooves 430 are formed in the ring such that they vary slightly in angle, as seen in FIGS. 10A–10C. In particular, each groove is cut to one of two tapering depth angles. In the preferred embodiment, angle 431*b* is cut to an angle of 1.11 degrees off of the throughgoing axis line, and angle 431*a* is cut in an angle 3.01 degrees from the throughgoing axial line. The sequence of two progressing depths 431 is repeated around the entire circumference of the inside spray ring 420, as shown in FIG. 10A. When the inside spray ring 420 is secured in place between the aeration ring 210 and the turbine cup 310, the grooves 430 are covered by the aeration ring 210 to form orifices 435.

Turning now to FIGS. 2 and 3A–C, the showerhead 5 of the preferred embodiment of the present invention operates in the following manner. First, water from the water supply 19 flows into the connecting end 16 of the swivel ball fitting 15, and then into the central throughgoing passage 17. From the central throughgoing passage 17, the water flows into the central bore 26 of the central stem 23 of the selector housing 20. The water next flows into the opening 38 of hollow stem 40 of the selector disk 30, and then through the transverse aperture 46 in the stem.

From the transverse aperture 46, the water proceeds to flow into the axially throughgoing hole 36 in the selector disk. Depending on the rotational position of the selector disk, the water next flows through one or more of the selector holes 60 in the selector face 50. Preferably, since the range of rotation for the selector disk is limited by the stops 35 to slightly more than 180 degrees, and the selector holes are positioned around only this arc of the selector face, water is always passing from the axially throughgoing hole 36 into one or more of the selector holes 60. The user selects the desired position and spray made by turning selector ring 47 via the gripper 21.

There are ten total rotational positions of the selector disk. In the first position, the axially throughgoing hole 36 in the selector disk is in alignment and fluid communication with the pulsating selector hole 941 in the selector face. As a result, water flows through the smaller pulsating selector hole 941 at a slow rate and into the pulsating spray channel 85c of diffuser plate 70. The water slowly dribbles out of the pulsating exit hole 95*c* in the diffuser plate, and eventually out the front of the showerhead 5.

In the second position, the axially throughgoing hole 36 in the selector disk is in alignment and fluid communication with two of the small pulsating spray selector holes 941, 942. As a result, all of the water flows into the pulsating spray selector holes 941, 942 and then into the pulsating spray channels 85*c*, 85*b* of diffuser plate 70. From there, the water flows out of the pulsating spray exit holes 95*c*, 95*b* in the diffuser plate, and into the pulsating spray assembly 300 to produce a "soft massage" spray.

In the third position, the axially throughgoing hole 36 in the selector disk is in alignment and fluid communication with the small pulsating spray selector hole 942 and the pulsating spray selector hole 943, which is larger. As a result, all of the water flows into the pulsating spray selector holes 942, 943 and then into the pulsating spray channels 85*b*, 85*a* of diffuser plate 70. From there, the water flows out of the pulsating spray exit holes 95*b*, 95*a* in the diffuser plate, and into the pulsating spray assembly 300 to produce a "hard massage" spray.

In the fourth position, the axially throughgoing hole 36 in the selector disk is in alignment and fluid communication with one of the pulsating spray selector holes 943 and one of the outside spray ring selector holes 944 in the selector face. As a result, some of the water flows through the pulsating spray selector hole 943 as described above. The rest of the water flows into the outside spray ring selector hole 944 and then into the outside spray ring channel 84 of diffuser plate 70. From there, the water flows out of the outside spray ring exit holes 94 in the diffuser plate, and into the outside spray ring 440. Water then exits to a user through the orifices 455 in the outside spray ring 440.

In the fifth position, the axially throughgoing hole 36 in the selector disk is in alignment and fluid communication with both of the outside spray ring selector holes 944, 945. As a result, all of the water flows into the outside spray ring selector holes 944, 945 and then into the outside spray ring channel 84 of diffuser plate 70. From there, the water flows out of the outside spray ring exit holes 94 in the diffuser plate, and into the outside spray ring 440. The water flow to the outside spray ring in this fifth position is greater than the water flow to the outside spray ring in the fourth position due to the fact that in the fifth position, both outside spray ring selector holes 944, 945 are being used to transport water.

In the sixth position, the axially throughgoing hole 36 in the selector disk is in alignment and fluid communication with one of the outside spray ring selector holes 945 and one of the inside spray ring selector holes 946 in the selector face. As a result, some of the water flows through the outside spray ring selector hole 945 as described above. The rest of the water flows into the inside spray ring selector hole 946 and then into the inside spray ring channel 83 of the diffuser plate 70. The water subsequently flows out of the inside spray ring exit hole 93 in the diffuser plate, and into the inside spray ring 420.

In the seventh position, the axially throughgoing hole 36 in the selector disk is in alignment and fluid communication with two of the inside spray ring selector holes 946, 947. As a result, all of the water flows into the inside spray ring selector holes 946, 947 and then into the inside spray ring channel 83 of diffuser plate 70. From there, the water flows out of the inside spray ring exit hole 93 in the diffuser plate, and into the inside spray ring 420. The water flow to the inside spray ring in this seventh position is greater than the water flow to the inside spray ring in the sixth position due to the fact that in the seventh position two inside spray ring selector holes 946, 947 are being used to transport water.

In the eighth position, the axially throughgoing hole 36 in the selector disk is in alignment and fluid communication with the inside spray ring selector holes 947 and one of the aeration spray selector holes 948 in the selector face. As a result, some of the water flows through the inside spray ring selector hole 947 as described above. The rest of the water flows into the aeration spray selector hole 948 and then into the aeration spray channel 82 of diffuser plate 70. From there, the water flows out of the aeration spray exit holes 92 in the diffuser plate, and into the aeration spray assembly 200.

In the ninth position, the axially throughgoing hole 36 in the selector disk is in alignment and fluid communication with both of the aeration spray ring selector holes 948, 949. As a result, all of the water flows through the aeration spray selector holes 948, 949 and then into the aeration spray channel 82 of diffuser plate 70. From there, the water flows out of the aeration spray exit holes 92 in the diffuser plate, and into the aeration spray assembly 200. The water flow to the aeration spray assembly in this ninth position is greater than the water flow to the aeration spray assembly in the eighth position due to the fact that in the ninth position two aeration spray selector holes 948, 949 are being used to transport water.

In the tenth position, the axially throughgoing hole 36 in the selector disk is in alignment and fluid communication with the aeration spray selector hole 949 in the selector face. As a result, water flows through the smaller aeration selector hole 949 at a slow rate and into the aeration spray channel 82 of diffuser plate 70. The water slowly dribbles out of the aeration spray exit hole 92 in the diffuser plate, and eventually out the front of the showerhead 5.

Turning now to FIGS. 7A–E, the aeration spray assembly 200 operates in the following manner. Water from the aeration spray axially throughgoing exit holes 92 is accelerated into the mixing chamber 240 directly towards the inlet ports 222 of the aerated spray nozzles 220. Some of the water is encouraged by the metal mesh 221 capped on the inlet ports 222 to become turbulent and fill the mixing chamber 240. As the rest of the water is forced from the exit holes 92 towards the inlet port 222, to the intermediate port 226, and out through the outlet port 224 of the aerated spray nozzle 220, its flow rate is increased causing a vacuum effect in the mixing chamber 240. This vacuum effect in the mixing chamber 240 causes ambient air from the atmosphere to be drawn into the inlet ports 232 of the air intake apertures 230. The air is then drawn further to the outlet ports 234 of the air intake apertures 230 and into the mixing chamber 240 where the air is mixed with the turbulent water in the mixing chamber 240. Finally, the mixture of air and turbulent water in the mixing chamber flows into and out through the aerated spray nozzles 220 along with water forced directly from exit holes 92.

A second, alternative embodiment of the present invention is shown in FIGS. 11–14. As shown in the assembly drawing of FIG. 11, the showerhead 105 of this alternative embodiment comprises a shell 10, a selector housing 20, a selector disk 130, a selector face 150, a diffuser plate 170, an aeration spray assembly 200, a pulsating spray assembly 300, an inside spray ring 420, and an outside spray ring 440. As indicated by corresponding reference numerals, the shell 10, the selector housing 20, the aeration spray assembly 200, the pulsating spray assembly 300, the inside spray ring 420, and the outside spray ring 440 of the alternative embodiment are identical to the corresponding components of the preferred embodiment of showerhead 5 described above. In the alternative embodiment, however, the selector disk 130, the selector face 150, and the diffuser plate 170 implement an improved selection system for the showerhead 105. To avoid unnecessary repetition, only the selector disk 130, the selector face 150, and the diffuser plate 170 of the alternative embodiment will be described below.

Figure 12A:
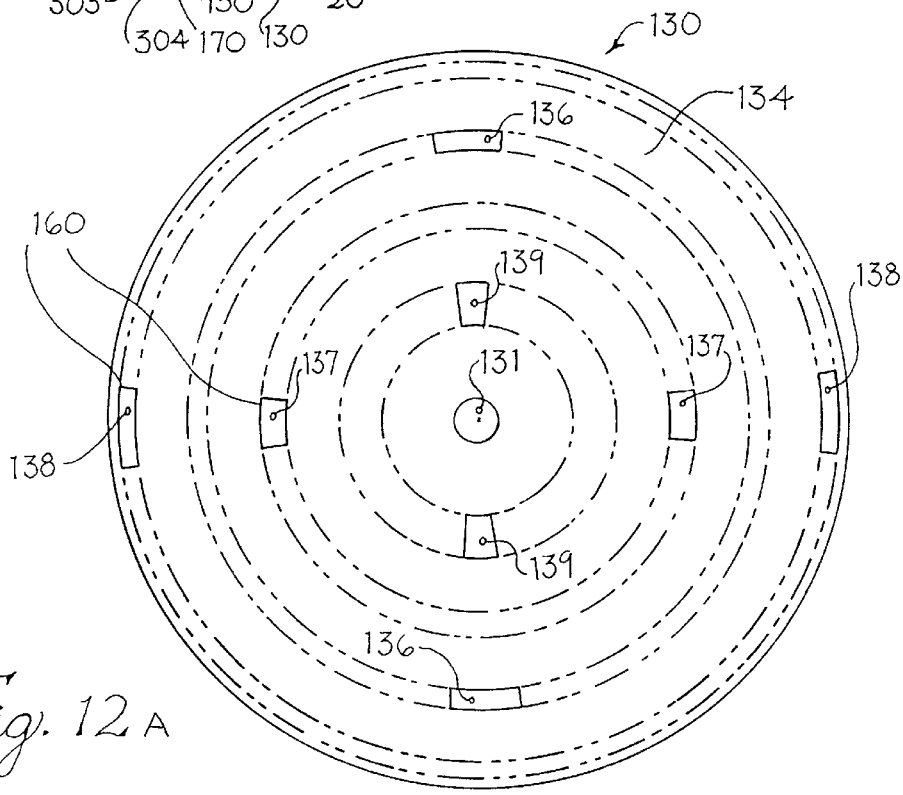
FIG. 12A is a front view of the selector disk of the second preferred embodiment of the present invention.
Figure 12B:
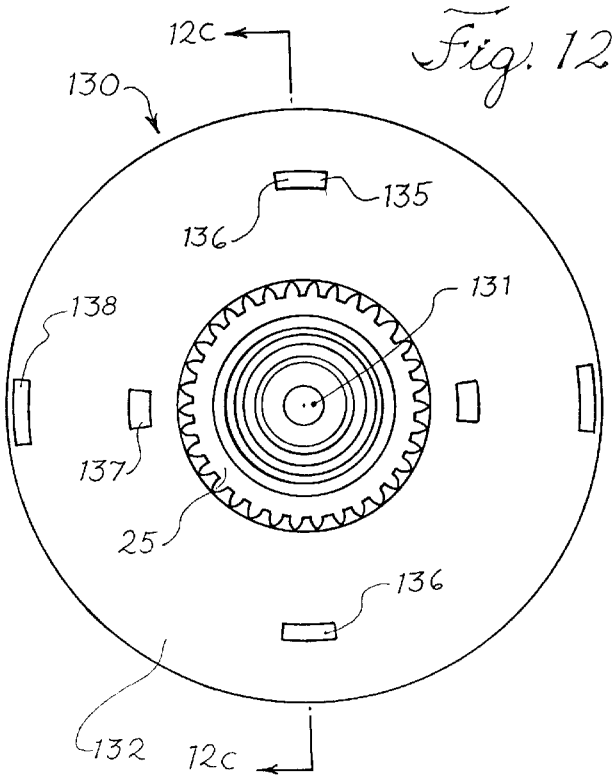
FIG. 12B is a rear view of the selector disk of FIG. 12A.
Figure 12C:
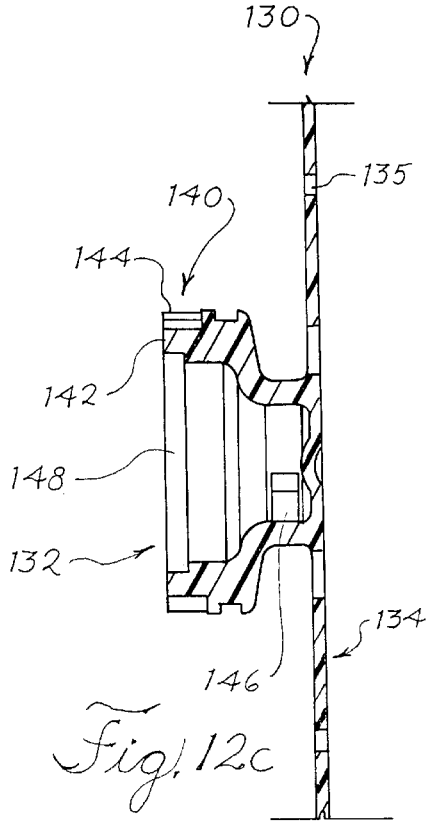
FIG. 12C is a cross-sectional view of the selector disk of FIG. 12A taken along line 12—12.

The selector disk 130, as shown in FIGS. 12A–C, is removably and rotatably mounted inside the selector housing 20 near the inlet end 22. The selector disk 130 has an inlet end 132 facing and spaced from the inlet end 22 of the selector housing 20, an outlet end 134 opposite the inlet end 132 of the selector disk 130, and a center 131. The inlet end 132 of the selector disk 130 is spaced from the inlet end 22 of the selector housing 20 to allow water to flow between the selector housing 20 and the selector disk 130. The selector disk 130 also defines at least one axially throughgoing hole 135 to allow water to flow through the selector disk 130. The axially throughgoing hole 135 is radially spaced from the center 131 of the selector disk 130.

Preferably, the selector disk 130 has four pairs of axially throughgoing holes, namely, aeration spray axially throughgoing holes 136, inside spray ring axially throughgoing holes 137, outside spray ring axially throughgoing holes 138, and pulsating spray axially throughgoing holes 139. Each pair of axially throughgoing holes includes two holes that are diametrically opposed and radially spaced an equal distance from the center 131 of the selector disk 130. In addition, each pair of axially throughgoing holes is arranged at different diameter with respect to the center 131 than the other pairs of axially throughgoing holes. As shown in FIG. 12A, the pulsating spray axially throughgoing holes 139 are arranged at a first diameter, the inside spray ring axially throughgoing holes 137 are arranged at a second diameter greater than the first diameter, the aeration spray axially throughgoing holes 136 are arranged at a third diameter greater than the second diameter, and the outside spray ring axially throughgoing holes 138 are arranged at a fourth diameter greater than the third diameter.

The selector disk 130 also has a hollow stem 140 projecting from the inlet end 132 of the selector disk 130, as shown in FIG. 12C. The stem 140 has a plurality of gear teeth 144 projecting radially outwardly from an end 142 of the stem 140 opposite the inlet end 132 of the selector disk 130. The hollow stem 140 has an opening 148 in the end 142 that is in fluid communication and alignment with the central bore 26 of the selector housing 20. In addition, the stem 140 has at least one transverse aperture 146 to allow water to flow from inside the hollow stem 140 to outside the stem between the selector housing 20 and the inlet end 132 of the selector disk 130.

Figure 11:
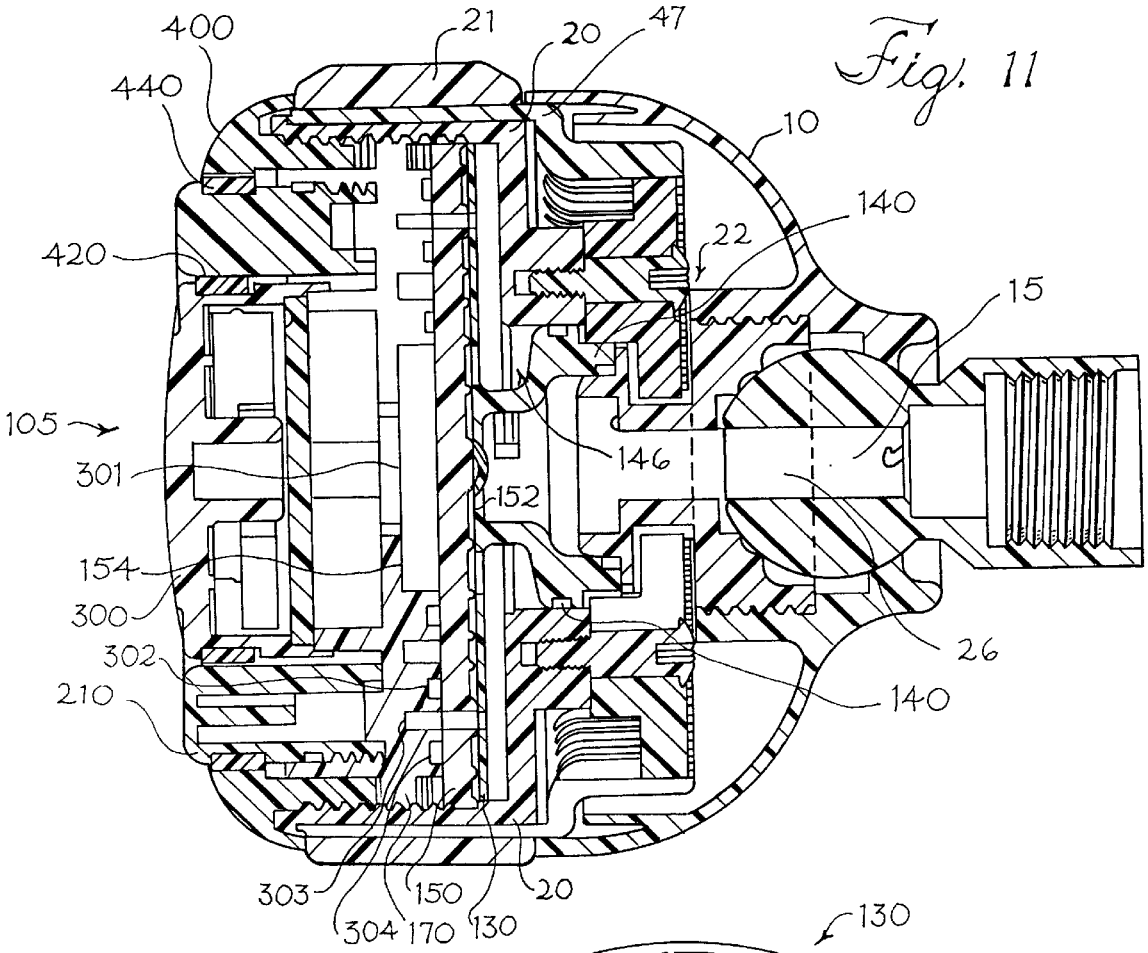
FIG. 11 is an assembly drawing of a second preferred embodiment of a showerhead of the present invention.

As shown in FIG. 11, the selector face 150 is threadably mounted inside the selector housing 20. The selector face 150 has an inlet end 152 that is flush against the outlet end 134 of the selector disk 130, an outlet end 154 opposite the inlet end 152 of the selector face 150, and a center 151.

Figure 14:
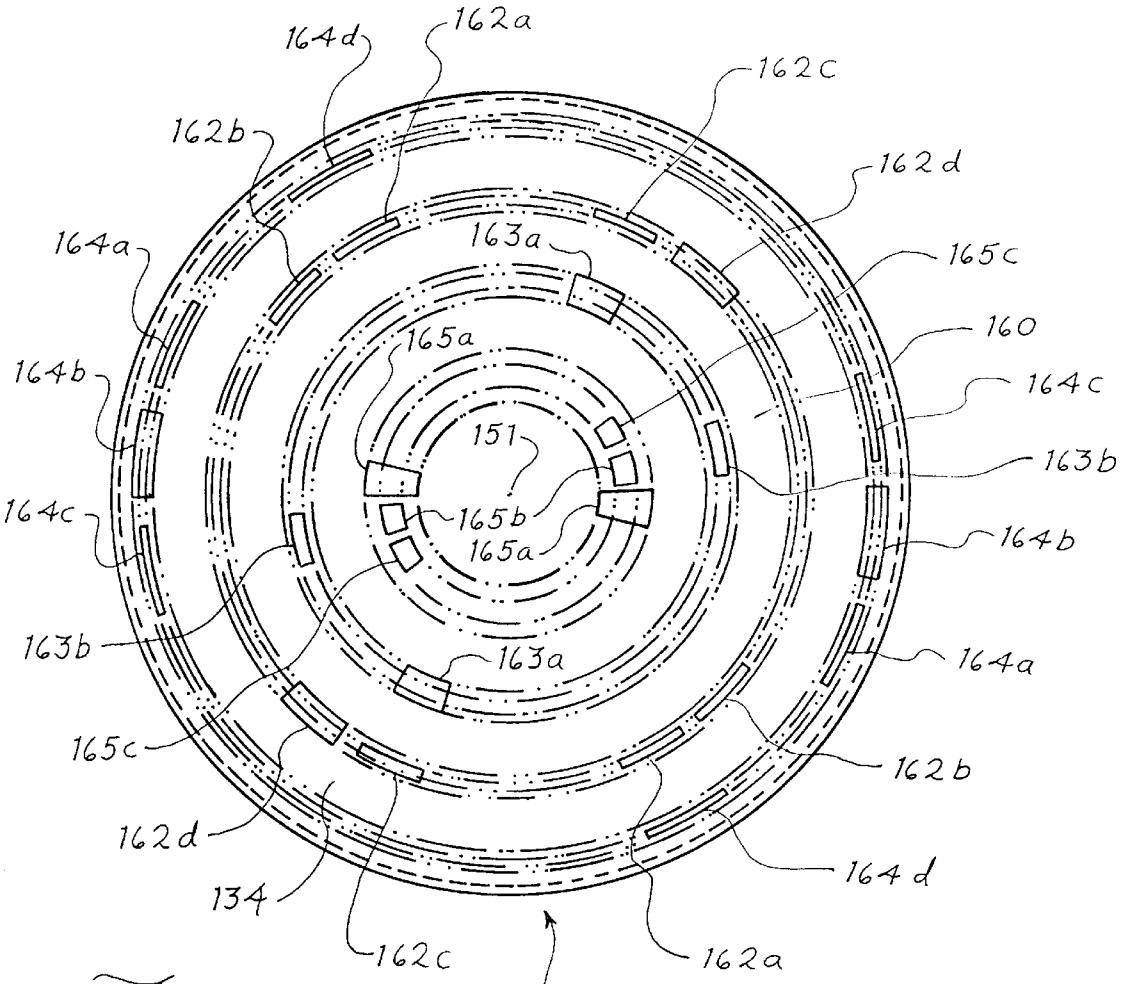
FIG. 14 is a front view of the selector face of the second preferred embodiment of the present invention.

As shown in FIG. 14, the selector face 150 also has at least one axially throughgoing selector hole 160 to allow water to flow through the selector face 150. The axially throughgoing selector hole 160 is radially spaced from the center 151 of the selector face 50 and is capable of alignment and fluid communication with the axially throughgoing holes 135–139 of the selector disk 130. The alignment of the axially throughgoing selector holes 160 and the axially throughgoing holes 135–139 depends on the rotational position of the selector disk 130 relative to the non-rotating selector face 150.

Preferably, there are thirteen pairs of axially throughgoing selector holes 160 that are capable of alignment and fluid communication with the axially throughgoing holes 135 upon rotation of the selector disk 130. In particular, there are four pairs of aeration spray selector holes 162*a–d*, two pairs of inside spray ring selector holes 163*a–b*, four pairs of outside spray ring selector holes 164*a–d*, and three pairs of pulsating spray selector holes 165*a–c*. Each pair of selector holes includes two holes that are diametrically opposed and radially spaced an equal distance from the center 151 of the selector face 150. One or more of the pairs of selector holes 160 may also be larger than the other pairs in order to increase the flow rate through the selector holes 160.

In addition, the pairs of selector holes are arranged at various diameters, with respect to the center 151 of the selector face 150, equivalent to the diameters of the pairs of axially throughgoing holes 135–139 of the selector disk 130. As shown in FIG. 14, the pulsating spray selector holes 165*a–c* are arranged at the first diameter, the inside spray ring selector holes 163*a–b* are arranged at the second diameter, the aeration spray selector holes 162*a–d* are arranged at the third diameter, and the outside spray ring selector holes 164*a–d* are arranged at the fourth diameter. As a result, the pulsating spray selector holes 165*a–c* are capable of alignment with the pulsating spray axially throughgoing holes 139, the inside spray ring selector holes 163*a–b* are capable of alignment with the inside spray ring axially throughgoing holes 137, the aeration spray selector holes 162*a–d* are capable of alignment with the aeration spray axially throughgoing holes 136, and the outside spray ring selector holes 164*a–d* are capable of alignment with the outside spray ring axially throughgoing holes 138.

Figure 13A:
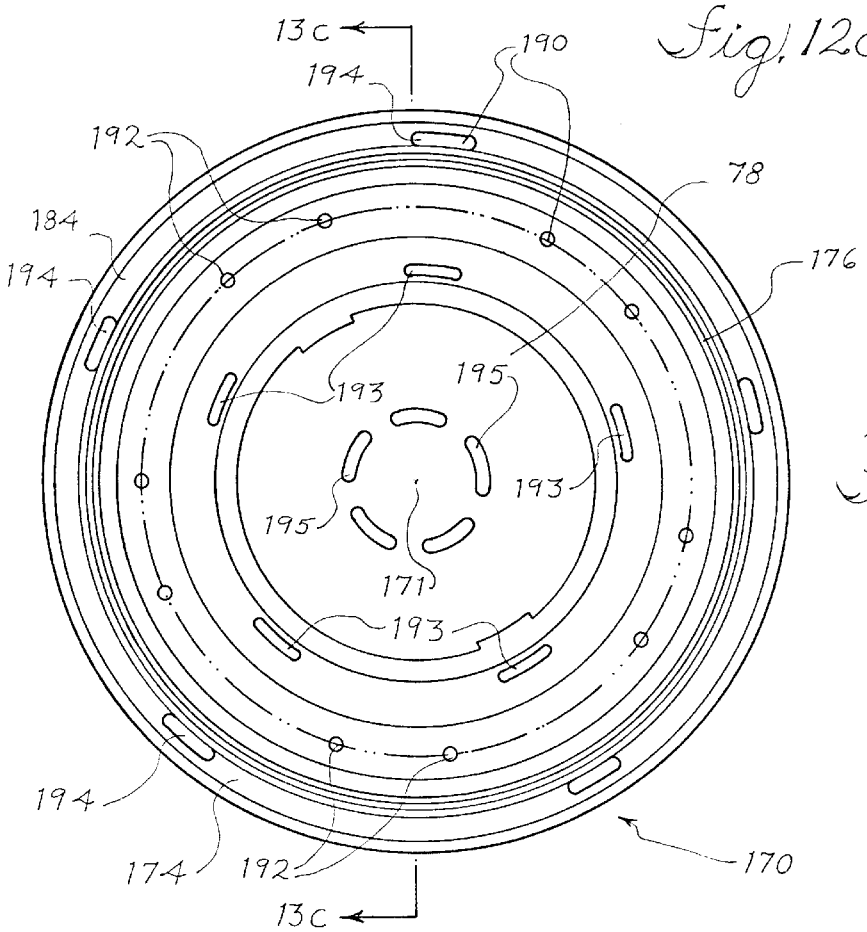
FIG. 13A is a front view of the diffuser plate of the second preferred embodiment of the present invention.
Figure 13B:
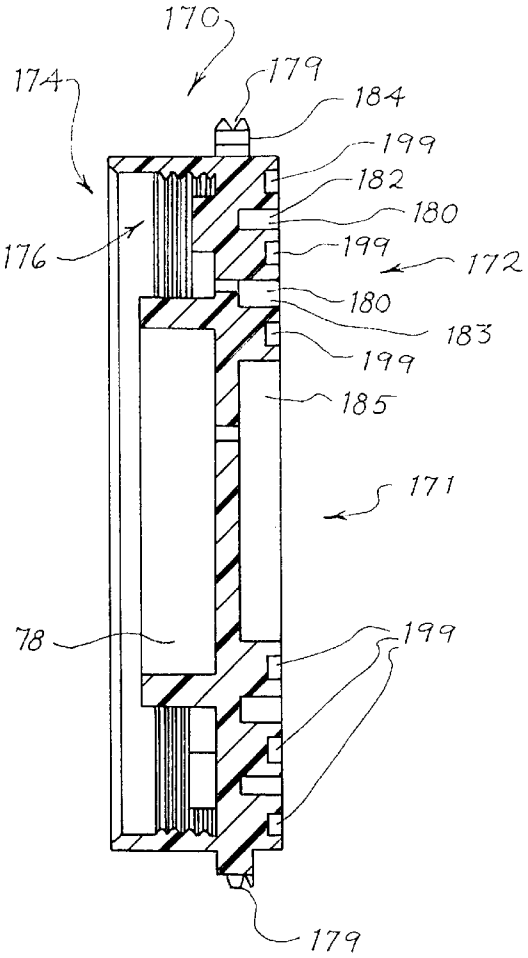
FIG. 13B is a cross-sectional view of the diffuser plate of FIG. 13A taken along line 13—13.

As shown in FIGS. 13A–B, the diffuser plate 170 is threadably mounted inside the selector housing 20 by threads 179. The diffuser plate 170 has an inlet end 172 that is flush against the outlet end 152 of the selector face 150, an outlet end 174 opposite the inlet end 172 of the diffuser plate 170, and a center 171. The outlet end 174 of the diffuser plate 170 has an upstanding aeration spray assembly mounting cup 176 for mounting the aeration spray assembly 200, and an upstanding pulsating spray assembly mounting cup 178 for mounting the pulsating spray assembly 300. The aeration spray assembly mounting cup 176 and the pulsating spray assembly mounting cup 178 are identical to the aeration spray assembly mounting cup 76 and the pulsating spray assembly mounting cup 78, respectively, of the showerhead 5 of the preferred embodiment described above.

The diffuser plate 170 has channels 180 on the inlet end 172 of the diffuser plate 170, and axially throughgoing exit holes 190 to connect the channel 180 to the outlet end 174 of the diffuser plate 170. The channels 180 are in fluid communication with the axially throughgoing selector holes 160, and the axially throughgoing exit holes 190 allow water to flow from the channels 180 out through the outlet end 174 of the diffuser plate 170.

Preferably, there are four channels including an aeration spray channel 182, an inside spray ring channel 183, an outside spray ring channel 184 (defined in part by housing 20), and a pulsating spray channel 185. As shown in FIG. 13B, the four channels are arranged as concentric circles at different diameters with respect to the center 171 of the diffuser plate 170. The four different diameters of the channels correspond to the four diameters of the axially throughgoing holes and the selector holes. The channels are preferably separated by elastomeric O-rings seated within grooves 199 between each channel.

The aeration spray channel 182 is arranged at the third diameter and is in fluid communication with the aeration spray selector holes 162*a–d* of the selector face 150. The aeration spray channel 182 has at least one axially throughgoing exit hole 192 to allow water to flow out of the outlet end 174 of the diffuser plate 170 and to the aeration spray assembly 200. Preferably, there are ten axially throughgoing exit holes 192 radially disposed at the third diameter with respect to the center 171 of the diffuser plate 170. The exit holes 192 correspond to the ten nozzles on the aeration spray assembly 200.

The inside spray ring channel 183 is arranged at the second diameter and is in fluid communication with the inside spray ring selector holes 163*a–b* of the selector face 150. The inside spray ring channel 183 has at least one axially throughgoing exit hole 193 also arranged at the second diameter to allow water to flow out of the outlet end 174 of the diffuser plate 170 and to the inside spray ring 420. Preferably, there are five axially throughgoing exit holes 193 radially disposed at the second diameter with respect to the center 171 of the diffuser plate 170. Each of these exit holes 193 is in the shape of an elongated slot.

The outside spray ring channel 184 is arranged at the fourth diameter and is in fluid communication with the outside spray ring selector holes 164*a–d* of the selector face 150. The outside spray ring channel 184 has at least one axially throughgoing exit hole 194 also arranged at the fourth diameter to allow water to flow out of the outlet end 174 of the diffuser plate 160 and to the outside spray ring 440. Preferably, there are five axially throughgoing exit holes 194 radially disposed at the fourth diameter with respect to the center 171 of the diffuser plate 170. Each of these exit holes 194 is in the shape of an elongated slot.

The pulsating spray channel 185 is arranged between the inside spray ring channel 183 and the center 171 of the diffuser plate 170. As a result, the pulsating spray channel 185 is in fluid communication with the pulsating spray selector holes 165*a–c* of the selector face 150. The pulsating spray channel 185 has at least one axially throughgoing exit hole 195 arranged near the first diameter to allow water to flow out of the outlet end 174 of the diffuser plate 170 and to the pulsating spray assembly 300. Preferably, there are five axially throughgoing exit holes 195 radially disposed near the first diameter with respect to the center 171 of the diffuser plate 170. Each of these exit holes 195 is in the shape of an elongated slot.

Preferably, O-rings are disposed between the various channels of the diffuser plate 170 to provide an improved seal between the selector face 150 and the diffuser plate 170.

Turning now to FIG. 11 in combination with the remaining figures, the showerhead 105 of the alternative embodiment of the present invention operates in the following manner. First, water from the water supply 19 flows into the connecting end 16 of the swivel ball fitting 15, and then into the central throughgoing passage 17. From the central throughgoing passage 17, the water flows into the central bore 26 of the central stem 23 of the selector housing 20. The water next flows into the opening 148 of hollow stem 140 of the selector disk 130, and then through the transverse aperture 146 in the stem.

From the transverse aperture 146, the water proceeds to flood the space between the selector housing and the rear of selector disk 13, and then flows into the pairs of axially throughgoing holes 135 in the selector disk. Depending on the rotational position of the selector disk, the water next flows through one or more of the pairs of selector holes 160 in the selector face 150.

There are ten total rotational positions of the selector disk in the present embodiment. The user may, however, continually rotate the selector disk 130 over a full 360 degrees. The method of rotation of the selector disk 130 by the user is preferably identical to that used in the previous embodiment, in that a selector ring 47 may be manipulated to cause rotation of idler gears. The idler gears may mesh with the teeth 144 to turn disk 130.

In the first position, selector holes 164*d* are rotationally aligned with throughgoing holes 138 in selector disk 130. In this position, selector holes 165*c* are also aligned with throughgoing holes 139 in the selector disk 130. As a result of this positioning, water flows from behind the selector disk 130 through the holes 138 and 139 in the selector disk 130, and subsequently through holes 164*d* and 165*c* in the selector face 150. From here, the water fills channels 184 and 185 to cause a slow pulsating spray from orifices 318 and a slow steady spray from outside spray ring 440. The remaining non-aligned holes in the selector face 150 are blocked by the solid portions of the selector disk 130, and therefore do not deliver any water.

Subsequent positioning of the selector disk 130 relative to the selector face 150 and diffuser plate 170 will be discussed as the selector disk 130 in FIG. 12A is rotated clockwise in relation to selector face 150 in FIG. 14. Thus, in the second position (wherein the next set of selector holes 160 align with holes in the selector face), throughgoing holes 139 align with holes 165*b* on selector face 150. Because no other holes are aligned between the two disks, water at a slightly higher flow rate fills channel 185 of the diffuser plate 170, thereby flooding the turbine cup and causing a medium-slow pulsating water flow out of orifices 318.

In the third position, throughgoing holes 139 in selector disk 130 align with larger holes 165*a* in the selector face 150. The increased water flow floods channel 185 and causes the pulsating spray assembly 300 to emit a higher flow rate pulsating spray from orifices 318, thereby producing a fast pulsating spray effect.

In the fourth position, throughgoing holes 137 in selector disk 130 align with holes 163*a* in the selector face 150. The subsequent water flow through these holes floods channel 183 in diffuser plate 170, causing water to exit holes 193 on the outlet side 174 of diffuser plate 170. The water is subsequently directed to the inside spray ring 420, which emits a fast-flowing steady stream.

In the fifth position, throughgoing holes 136 in the selector disk 130 align with holes 162*b* on selector face 150. The resulting water flow through these holes floods chamber 182, which causes water to be forced out the ten exit holes 192 on the outlet end of the diffuser plate 170. The water forced from holes 192 is accelerated into the aeration nozzles 220 and mixing chamber 240 in the aeration spray assembly 200 to produce a slow, aerated spray of water.

In the sixth position, throughgoing holes 136 in the selector disk 130 align with holes 162*a* in the selector face 150. Water flows through these holes to create an aerated spray in the same fashion as described for the fifth position above. However, because hole 162*a* is slightly larger than hole 162*b* in the selector face 150, the aerated spray is slightly stronger in the sixth position than in the fifth position.

In the seventh position, throughgoing holes 138 and 137 on selector disk 130 align with holes 164*c* and 163*b* in the selector face, respectively. The resulting water flow floods channel 184 and channel 183 in the diffuser plate 170, thus causing water to spray from both the inside spray ring 420 and the outside spray ring 440 on the showerhead 105. The spray output from these rings is steady.

In the eighth position, throughgoing holes 138 on selector disk 130 align with larger holes 164*b* on the selector face 150. The resulting water flow floods channel 184 in diffuser plate 170, thus causing water to be output exit holes 194. The water flows out through outside spray ring 440 at a fast flow rate, since all other flow paths are blocked.

In the ninth position, throughgoing holes 138 and 136 of selector disk 130 align with holes 164*a* and 162*c*, respectively. The resulting water flow floods channels 184 and 182, to result in a combined slow aerated spray from nozzles 220 and a slow steady spray from outside spray ring 440.

Finally, in a tenth position, throughgoing holes 136 in selector disk 130 align with holes 162*d* on selector face 150. The resulting water flow through larger holes 162*d* floods channel 182 at a higher flow rate, thus producing a fast aerated spray from nozzles 220.

The operation of the aeration spray assembly 200 and the pulsating spray assembly 300 is identical to the operation of these assemblies in the first embodiment described above. As in the first embodiment, various gaskets and seals may be necessary to effectively promote water integrity between components.

One of the benefits of the present embodiment of the showerhead 105 is that all of the selector components are rotationally independent. Therefore, circumferential alignment between the components is not critical, since the various channels and orifices will still register with each other even in widely varying rotational positions. This allows users to more easily disassemble the unit for cleaning without concern for precise repositioning of parts upon reassembly.

In operation, the present invention can be applied with particular advantage to a water supply pipe in any common shower. Although the showerhead of the present invention is shown and described with a wall-mounted configuration, the showerhead of the present invention may also be easily converted to a hand-held configuration. All of the components of the hand-held configuration would be identical to the wall-mounted configuration, with the exception that the shell would be modified to encompass the hand-held configuration including a flexible water supply hose. Furthermore, a backflow prevention device would be necessary to prevent water from siphoning from the hose back into the water supply.

Since most of the components used in the showerheads of the present invention, especially the ones that have water flowing through them, are either threadably mounted or snap-fitted to each other, it is very easy to disassemble and assemble the showerhead of the present invention. As a result, the various components of the showerhead may be easily removed and cleaned. Cleaning the showerhead components improves the water flow through them and thus enhances the overall performance and life of the showerhead. Cleaning, assembly, disassembly, the integrity of various seals and the ease of manipulations of the various components are facilitated by the application of a sealing lubricant, such as petroleum jelly, applied to the moving parts within the showerhead.

Figure 15:
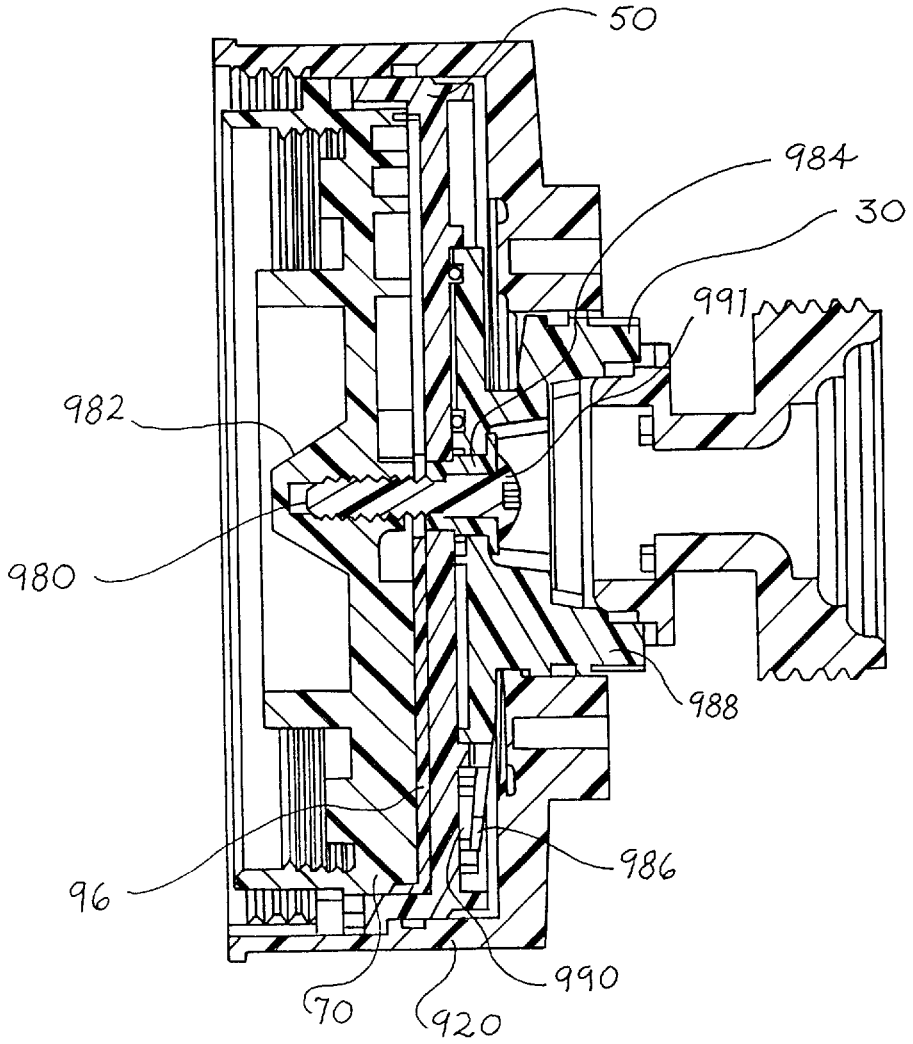
FIG. 15 is a perspective view of the present invention.

In order to simplify the assembly of the internal parts of the showerhead, such as in the first embodiment of FIGS. 1–10, it may be desirable to use a fastener to sandwich the internal moving parts to the non-moving parts of the showerhead. For example, the spring 89 used to hold the selector disk 30 to the selector face 50 may be replaced by a central fastener, as shown in the third alternate embodiment shown in the assembly drawing of FIG. 15. As shown in the figure, a raised screw receiving portion 982 is defined in the center of diffuser plate 70 at the outlet end of the plate 70. A central, threaded bore 980 is defined within the plate through the receiving portion 982 to receive threaded metal screw 991.

In this alternate embodiment, a bore is defined at the center of the diffuser gasket 96, selector face 50 and selector housing 20. The screw 991 is inserted through these components and threaded into the receiving portion 982. In order to allow the parts to freely rotate, a spacer is inserted into the overlaying bores. This prevents the screw 991 from unscrewing from the receiving portion 982.

The metal screw thus holds the diffuser plate 70, the diffuser gasket 96, the selector face 50, and the selector housing 20 together, while still allowing the selector disk 30 to rotate relative to the other components.

Preferably, a detent arm 986 projects from one side of the selector disk 30 to positively engage detents or grooves 990 on the selector face 50. This provides the user with a more definite way to identify setting locations on the selector assembly. Finally, in this embodiment, a through hole is defined within the selector disk 30 to flood the area between the selector face 50 and the housing 20.

To facilitate disassembly of the above showerheads, slots 700 may be formed in, for example, either the collar 400 or the edge of the aeration ring 210 to receive a disassembly range. The range may be made of rigid plastic and molded to specifically conform to the particular model of showerhead sold by the manufacturer. The user can engage the wrench with two or more of the slots 700 to threadably remove the components of the showerhead 5.

The holes, orifices, and/or apertures in the various components of the showerhead of the present invention may also be smaller or larger in size to better control the flow rate of the water passing through them. The larger the hole, orifice, or aperture, the greater the flow rate. Of course, such a modification of the holes, orifices, and/or apertures is dependent on manufacturing and consumer preferences.

Those skilled in the art to which the invention pertains may make modifications and other embodiments employing the principles of this invention without departing from its spirit or essential characteristics, particularly upon considering the foregoing teachings. The described embodiments are to be considered in all respects only as illustrative and not restrictive and the scope of the invention is, therefore, indicated by the appended claims rather than by the foregoing description. Consequently, while the invention has been described with reference to particular embodiments, modifications of structure, sequence, materials and the like would be apparent to those skilled in the art, yet still fall within the scope of the invention.

What is claimed is:

1. A showerhead comprising:

a shell having an inlet end and an outlet end spaced from the inlet end;

a selector housing having an inlet end and an outlet end, the inlet end of the selector housing being fixedly mounted to the outlet end of the shell;

a selector disk removably and rotatably mounted inside the selector housing near the inlet end of the selector housing, the selector disk having an inlet end facing the inlet end of the selector housing, and an outlet end opposite the inlet end of the selector disk, said disk having at least one axially throughgoing hole;

a selector face mounted inside the selector housing, the selector face having an inlet end abutting the outlet end of the selector disk, and an outlet end opposite the inlet end of the selector face, said selector face having at least one axially throughgoing hole capable of being aligned with the axially throughgoing hole of the selector disk; and a diffuser plate mounted inside the selector housing, the diffuser plate having an inlet end abutting the outlet end of the selector face, and an outlet end opposite the inlet end of the diffuser plate, the diffuser plate having at least one annular channel on the inlet end of the diffuser plate, the channel being in fluid communication with the axially throughgoing hole of the selector face, and the channel containing at least one axially throughgoing exit hole connecting the channel to the outlet end of the diffuser plate.

2. The showerhead of claim 1 further comprising:

an aeration spray assembly threadably mounted to the outlet end of the diffuser plate, the aerator assembly having a central aperture.

3. The showerhead of claim 2 wherein the aeration spray assembly further comprises:

an aeration ring having an inlet end threadably mounted to the outlet end of the diffuser plate, an outlet end opposite the inlet end of the aeration ring, at least one aerated spray nozzle having a venturi nozzle configuration, and at least one air intake aperture; and a mixing chamber radially disposed between the inlet end of the aeration ring and the outlet end of the diffuser plate.

4. The showerhead of claim 2 further comprising:

a pulsating spray assembly mounted to the outlet end of the diffuser plate within the central aperture of the aeration spray assembly.

5. The showerhead of claim 4 wherein the pulsating spray assembly comprises:

a turbine cup having an inlet end mounted to the diffuser plate, an outlet end having a flat interior bottom with a plurality of axially throughgoing exit holes in the bottom, and a central post upstanding from the bottom;

a rotary turbine disposed around the central post of the turbine cup, the rotary turbine having an outlet end facing the bottom of the outlet end of the turbine cup, a valving projection partially covering the outlet end of the rotary turbine, and a plurality of impellers; and a cover plate disposed on the inlet end of the turbine cup between the cup and the diffuser plate, the cover plate having at least one partially transverse throughgoing nozzle.

6. The showerhead of claim 2 further comprising:

a collar threadably mounted inside the outlet end of the selector housing and around the aeration spray assembly; and an outside spray ring disposed between the aeration spray assembly and the collar.

7. The showerhead of claim 4 further comprising an inside spray ring disposed between the aeration spray assembly and the pulsating spray assembly.

8. The showerhead of claim 1 further comprising:

a stem projecting from the inlet end of the selector disk, the stem defining a plurality of gear teeth projecting radially outwardly from an end of the stem;

at least one idler gear having gear teeth, the gear teeth of the idler gear registering with the gear teeth of the stem; and a selector ring disposed around the selector housing, the selector ring having gear teeth projecting radially inwardly, the gear teeth of the selector ring registering with the gear teeth of the idler gear.

9. A showerhead having an inlet end and an outlet end, said showerhead comprising:

a plate mounted between said inlet end and said outlet end of said showerhead, said plate having a plurality of throughgoing orifices for the conveyance of water therethrough;

an aeration member in fluid communication with said plate, said aeration member having a plurality of nozzles, said nozzles each having an inlet end, a reduced diameter portion and an outlet end, said inlet ends of said nozzles aligned with said orifices in said plate to allow said orifices to project water into said nozzles, said aeration member defining at least one mixing chamber linking the inlet ends of at least two of said nozzles;

a mesh screen positioned over the inlet end of at least one of said nozzles; and at least one air intake in fluid communication with said at least one mixing chamber.

10. The showerhead of claim 9 wherein said mesh screen further comprises metal.

11. The showerhead of claim 10 wherein said aeration member further comprises a ring, and said nozzles are positioned axially through said ring.

12. The showerhead of claim 11 wherein said reduced diameter portions of said nozzles impart a Venturi effect to water forced therethrough.

13. The showerhead of claim 12 wherein water within said mixing chamber becomes turbulent upon the forcing of water through said nozzles, said turbulent water causing aeration of the water in said mixing chamber with air flowing from said air intake.

14. The showerhead of claim 9 further comprising a plurality of elongated fins positioned axially within said nozzles near the outlet ends of said nozzles.

15. A pulsating spray assembly for a showerhead, said assembly comprising:

a turbine cup having a flat interior bottom, said bottom defining a plurality of axially throughgoing outlet orifices;

a post upstanding from said interior bottom;

a rotary turbine defining a central bore adapted to receive said post, said turbine having a plurality of radially extending impellers and at least one planar valving projection having an underside positionable flush with said interior bottom to cover at least one of said orifices in any rotational position over said interior bottom, said valving projection defining at least one groove on said underside.

16. The pulsating spray assembly of claim 14 wherein said at least one groove is concentric with and radially spaced a first distance from said bore.

17. The pulsating spray assembly of claim 15 wherein said groove has a partially rectangular cross-section.

18. The pulsating spray assembly of claim 15 further comprising a second groove radially spaced a second distance from said bore.

19. The pulsating spray assembly of claim 14 further comprising:

a planar propulsion member positioned over said turbine cup, said member defining a plurality of partially transverse nozzles oriented to create a circular flow of water.

20. A selector device for a showerhead having an inlet end, an outlet end and a plurality of spray orifices defined on said outlet end, said device comprising:

a selector disk having an outer edge and an inlet end, an outlet end and a stem upstanding from said disk, said stem defining a central bore in fluid communication with a transverse aperture defined within said stem, said disk defining an axially throughgoing hole;

a selector face overlying said selector disk, said selector face having an upstanding ridge adapted to surround the edge of said selector disk and defining a plurality of selector holes through said disk, said selector holes spaced along a single diameter and alignable with said axially throughgoing hole of said selector disk; and a diffuser plate overlying said selector face, said plate having a plurality of channels linking each of said selector holes with a spray orifice on the outlet end of said showerhead;

wherein said selector disk is rotatable relative to said selector face and said diffuser plate to align said axially throughgoing hole with at least one of said selector holes.

21. The selector device of claim 20 further comprising:

a selector housing defining a cupped interior, said interior adapted to receive said selector disk, said selector face, and said diffuser plate in overlying relationship; and means defined within said selector housing to prevent misalignment of said selector disk, said selector face, and said diffuser plate relative to each other.

22. The selector device of claim 21 further comprising:

a manually turnable gripper ring; and gear means linking said gripper ring with said selector disk for turning said disk upon turning said gripper ring.

23. The selector of claim 22 further comprising:

a screw receiving portion defined in the radial center of said diffuser plate;

a bore defined in the radial center of said selector face;

a bore defined in the radial center of said selector disk;

a spacer inserted within said bores; and a screw inserted through said spacer and said bores, said screw secured to said screw receiving portion of said diffuser plate.

* * * * *